US011415131B2

(12) United States Patent
Lee et al.

(10) Patent No.: US 11,415,131 B2
(45) Date of Patent: Aug. 16, 2022

(54) SCROLL COMPRESSOR

(71) Applicant: LG ELECTRONICS INC., Seoul (KR)

(72) Inventors: Minjin Lee, Seoul (KR); Minjae Kim, Seoul (KR); Jeonghun Kim, Seoul (KR); Jinhak Choi, Seoul (KR); Youngbae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/502,124

(22) Filed: Oct. 15, 2021

(65) Prior Publication Data

US 2022/0154718 A1 May 19, 2022

(30) Foreign Application Priority Data

Nov. 18, 2020 (KR) ..... 10-2020-0154833

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0261* (2013.01); *F04C 18/0269* (2013.01);
(Continued)

(58) Field of Classification Search
CPC F04C 18/0215; F04C 18/0261; F04C 23/008; F04C 14/12; F04C 28/12; F04C 28/26
See application file for complete search history.

(56) References Cited

U.S. PATENT DOCUMENTS 7,513,753 B2 * 4/2009 Shin et al. ..... F04C 28/0215 417/310
2003/0012659 A1 1/2003 Seibel et al.
(Continued)

FOREIGN PATENT DOCUMENTS

KR 10-2018-0089774 8/2018
KR 10-2072154 1/2020

OTHER PUBLICATIONS

Korean Office Action dated Nov. 15, 2021.

*Primary Examiner* — Deming Wan
(74) *Attorney, Agent, or Firm* — Ked & Associates LLP

(57) ABSTRACT

A scroll compressor may include a compressor chamber, a back pressure chamber, a first intermediate pressure hole, a second intermediate pressure hole, a third intermediate pressure hole, a back pressure switching unit configured to selectively connect the first intermediate pressure hole and the back pressure chamber or the second intermediate pressure hole and the back pressure chamber, a capacity variable unit configured to selectively open and close a capacity variable passage, and a mode switching unit provided outside of the casing and configured to control opening and closing operations of the back pressure switching unit and the capacity variable unit. This may simplify the structure of the back pressure switching unit and the mode switching unit, thereby maintaining compactness of the compressor while installing the back pressure switching unit inside of the casing, and thus, operation reliability of the mode switching unit may be secured and maintenance facilitated.

23 Claims, 12 Drawing Sheets

(51) Int. Cl.

| | |
|---|---|
| ***F04C 14/12*** | (2006.01) |
| ***F04C 28/12*** | (2006.01) |
| ***F04C 28/26*** | (2006.01) |
| ***F04C 29/06*** | (2006.01) |

(52) U.S. Cl.
CPC ..... *F04C 23/008* (2013.01); *F04C 29/068* (2013.01); *F04C 2240/30* (2013.01)

(56) References Cited

U.S. PATENT DOCUMENTS

| | | | | |
|---|---|---|---|---|
| 2011/0052437 | A1* | 3/2011 | Litsuka et al. ..... | F04C 28/26 418/55.1 |
| 2011/0058972 | A1* | 3/2011 | Patel et al. ..... | F04C 28/26 418/16 |
| 2015/0345493 | A1 | 12/2015 | Lochner et al. | |

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2020-0154833, filed in Korea on Nov. 18, 2020, the contents of which are incorporated by reference herein in their entirety.

BACKGROUND

1. Field

A scroll compressor, and more particularly, a scroll compressor equipped with a capacity-variable device are disclosed herein.

2. Background

In a scroll compressor, an orbiting scroll and a non-orbiting scroll are engaged to be coupled with each other, and as the orbiting scroll performs an orbiting motion with respect to the non-orbiting scroll, a pair of compression chambers is formed between the orbiting scroll and the non-orbiting scroll. Each of the pair of compression chambers includes a suction pressure chamber formed at a rim, an intermediate pressure chamber sequentially formed while gradually decreasing in volume from the suction pressure chamber toward a central portion, and a discharge pressure chamber connected to the intermediate pressure chamber. Normally, the suction pressure chamber is formed at a side surface of the non-orbiting scroll and communicates with a refrigerant suction pipe, the intermediate pressure chamber is sealed, and the discharge pressure chamber is formed through a center of an end plate of the non-orbiting scroll and communicates with a refrigerant discharge pipe.

In the scroll compressor, as two compression chambers form a pair, the non-orbiting scroll and the orbiting scroll should be tightly sealed in an axial direction to suppress leakage between the two compression chambers. Thus, the scroll compressor has a back pressure structure in which the orbiting scroll is pressed toward the non-orbiting scroll, or conversely, the non-orbiting scroll is pressed toward the orbiting scroll. The former may be defined as an "orbiting back pressure method", and the latter may be defined as a "non-orbiting back pressure method".

In the orbiting back pressure method, a back pressure chamber is formed between an orbiting scroll and a main frame that supports the orbiting scroll, and in the non-orbiting back pressure method, a back pressure chamber is formed on a rear surface of a non-orbiting scroll. More particularly, in the non-orbiting back pressure method, a separately manufactured back pressure chamber assembly may be fastened to the rear surface of the non-orbiting scroll.

In general, the orbiting back pressure method is applied to a structure in which the non-orbiting scroll is fixed to the main frame, and the non-orbiting back pressure method is applied to a structure in which the non-orbiting scroll is axially movable with respect to the main frame. U.S. Patent Publication No. US 2003/0012659 A1 (hereinafter, "Patent Document 1"), which is hereby incorporated by reference, discloses a scroll compressor to which the non-orbital back pressure method is applied.

In Patent Document 1, an annular back pressure chamber is formed on a back surface of a non-orbiting scroll, and a ring member forming an upper surface of the back pressure chamber is slidably inserted into the back pressure chamber. Accordingly, in Patent Document 1, the ring member moves up and down by a pressure of the back pressure chamber to adjust a pressure in the back pressure chamber.

In addition, in the scroll compressor, when sizes of the non-orbiting wrap and the orbiting wrap are determined, a suction volume and a discharge volume are determined, and a compression ratio of the corresponding compressor is determined. Then, the compressor compresses refrigerant according to the determined compression ratio.

Recently, a so-called capacity variable scroll compressor that adjusts the compression ratio according to an operation mode has been introduced. The capacity variable scroll compressor compresses the entire refrigerant up to an outlet in a power mode, while in a saving mode, the capacity variable scroll compressor bypasses a portion of the compressed refrigerant before the refrigerant reaches the outlet so as to lower the compression ratio.

In the capacity variable scroll compressor, the lower a variable ratio of a compression capacity (hereinafter, "cooling capacity"), in other words, the lower the compression capacity in a partial load operation (hereinafter, "saving operation") compared to the compression capacity in a power operation when the compression capacity in a full load operation (hereinafter, "power operation") is 100%, the more advantageous it is in terms of a load of a refrigeration cycle device (or air conditioning system). However, in the related art, it was difficult to properly adjust the pressure in the back pressure chamber according to the operation mode of the compressor because the pressure in the back pressure chamber was adjusted using an intermediate pressure at one point.

Korean Patent Registration No. 10-2072154 (hereinafter "Patent Document 2"), which is hereby incorporated by reference, discloses a technique for adjusting a pressure in a back pressure chamber using a plurality of different intermediate pressures. An operation mode switching valve applied to Patent Document 2 is configured such that a valve coil portion constituting a power supply is formed integrally with a valve portion to allow the valve portion of the operation mode switching valve to be operated between low intermediate pressures or high intermediate pressures by the valve coil portion.

However, in Patent Document 2, a total length of the valve is increased as the valve coil portion is formed right next to the valve portion. In particular, at the valve portion, there is provided a plurality of (four) O-rings. As the valve portion should overcome frictional force caused by the O-rings when operating, a volume of the valve coil portion becomes larger. Nevertheless, as the valve coil portion is installed outside of the compression portion in the casing, there should be enough space between the compression portion and an inner circumferential surface of the casing (or an inner circumferential surface of a high and low pressure separation plate) to allow installation of the operation mode switching valve. For this reason, it may be difficult to install the operation mode switching valve in a limited inner space of the casing, or an outer diameter of the compressor may increase due to the operation mode switching valve.

In addition, in Patent Document 2, as the valve coil portion is installed inside of the casing, not only a separate power line for mode switching configured to apply power to the valve coil portion, but also a terminal for mode switching is needed. This may increase a complexity in a power supply structure of the compressor, thereby increasing manufacturing costs. In addition, as the valve coil portion for controlling the mode switching valve is installed inside of the casing in Patent Document 2, it may be disadvantageous not only in securing operational reliability for the mode switching valve, but also in maintaining the mode switching valve.

BRIEF DESCRIPTION OF THE DRAWINGS

Embodiments will be described in detail with reference to the following drawings in which like reference numerals refer to like elements, and wherein.

DETAILED DESCRIPTION

Figure 1:
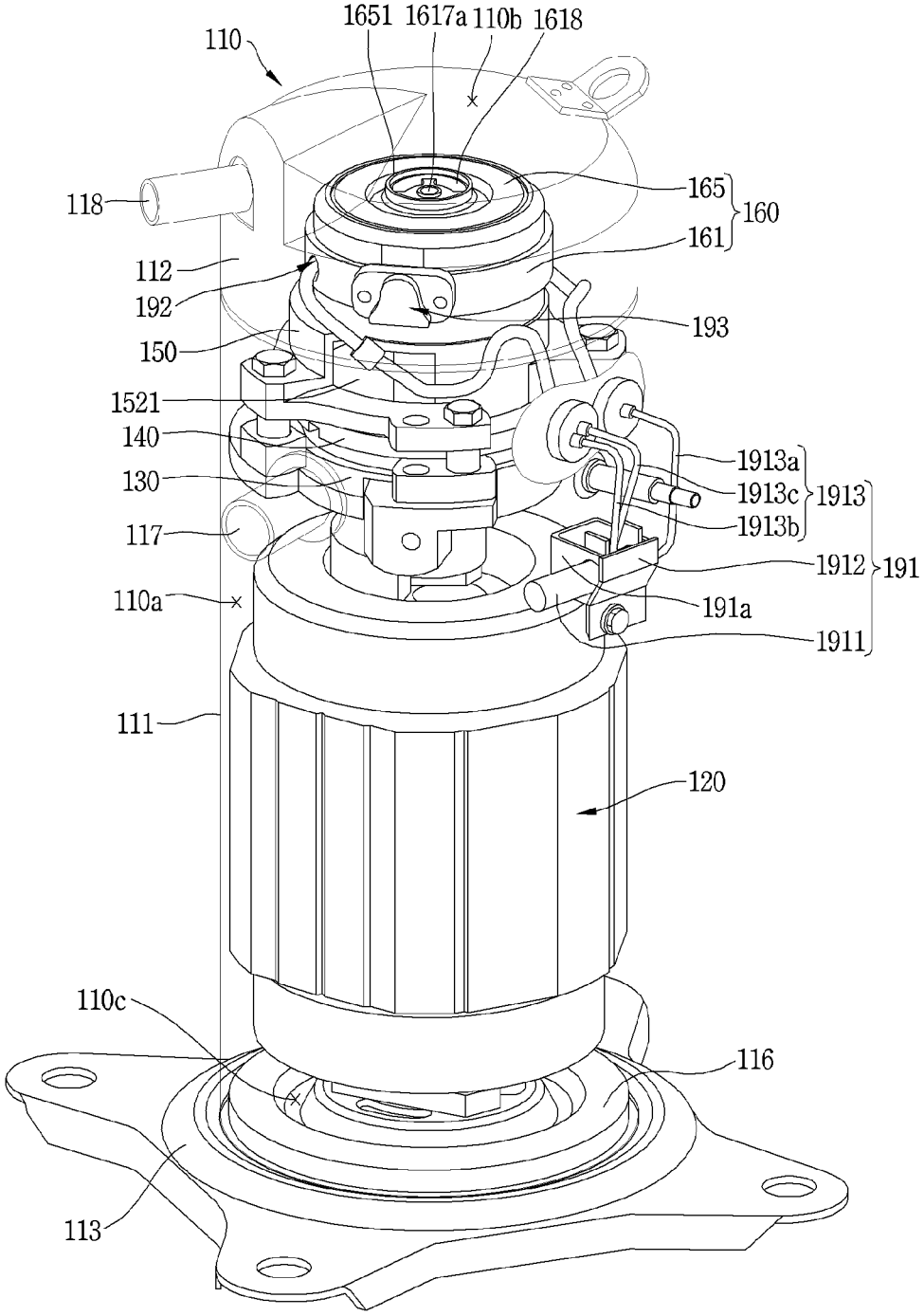
FIG. 1 is a perspective view illustrating an inside of a capacity-variable scroll compressor in accordance with an embodiment.

Description will now be given of a scroll compressor according to embodiments, with reference to the accompanying drawings. Whenever possible, the same or like reference numerals have been used to indicate the same or like components, and repetitive disclosure has been omitted.

In general, scroll compressors, like other compressors, may be classified as low-pressure compressors or high-pressure compressors according to which pressure portion is formed in an inner space of a casing, more particularly, a space accommodating a motor unit. In the former case, the space may form a low-pressure portion and a refrigerant suction pipe may communicate with the space. In the latter case, the space may form a high-pressure portion and the refrigerant suction pipe may be formed through the casing so as to be directly connected to a compression unit. This embodiment relates to a low-pressure scroll compressor.

In addition, the scroll compressor may be classified as a single capacity type compressor or a variable capacity type compressor according to an application range of a compressor chamber. The former is a method of utilizing an entire section of the compressor chamber, and the latter is a method of utilizing the entire or a portion of the section of the compression chamber as needed. This embodiment relates to a variable capacity type scroll compressor. The variable capacity type scroll compressor will be defined as a capacity variable scroll compressor, and will be abbreviated as a scroll compressor, except in exceptional cases below.

Figure 2:
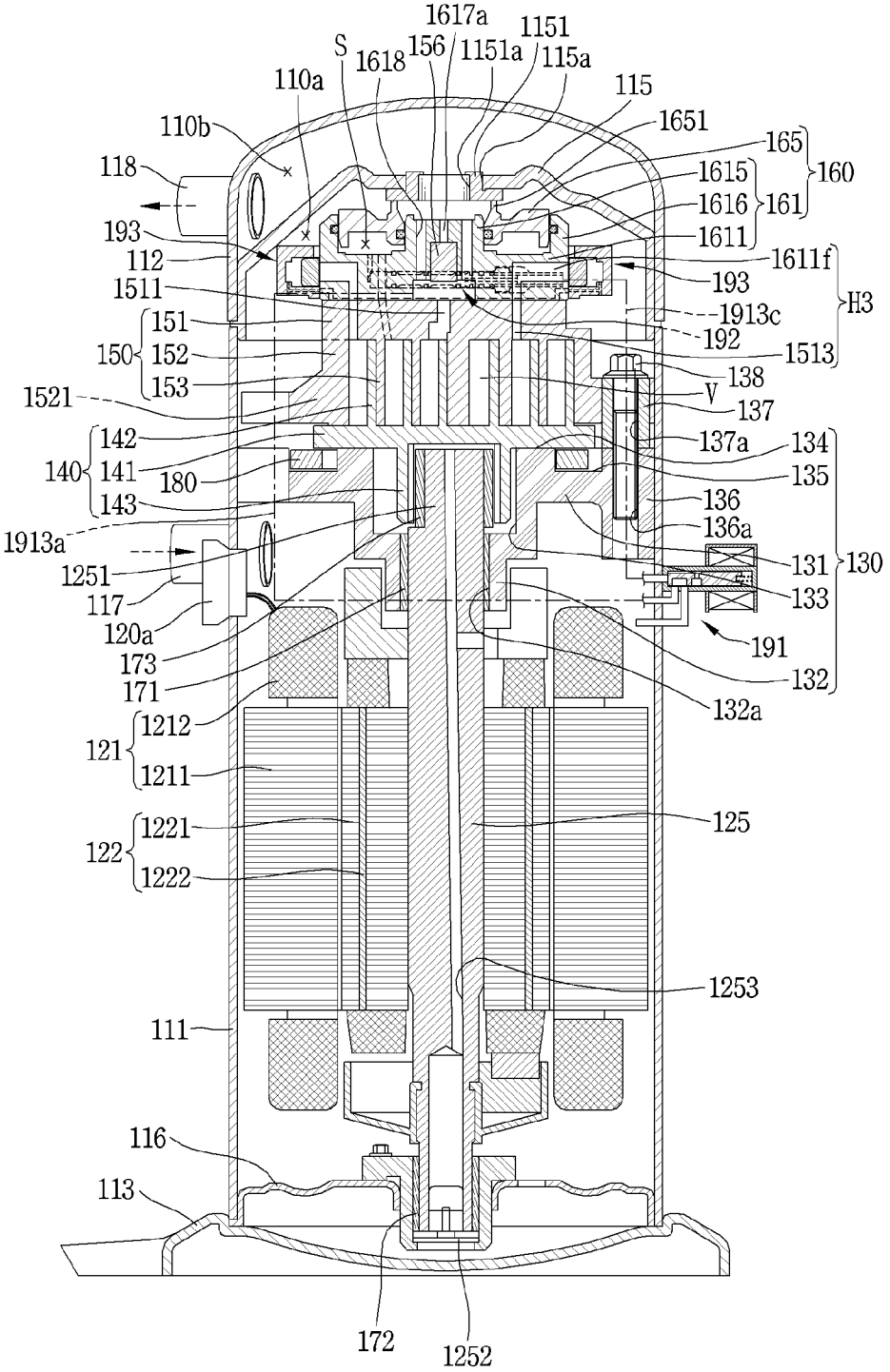
FIG. 2 is a longitudinal cross-sectional view illustrating an inside of the capacity-variable scroll compressor of FIG. 1.
Figure 3:
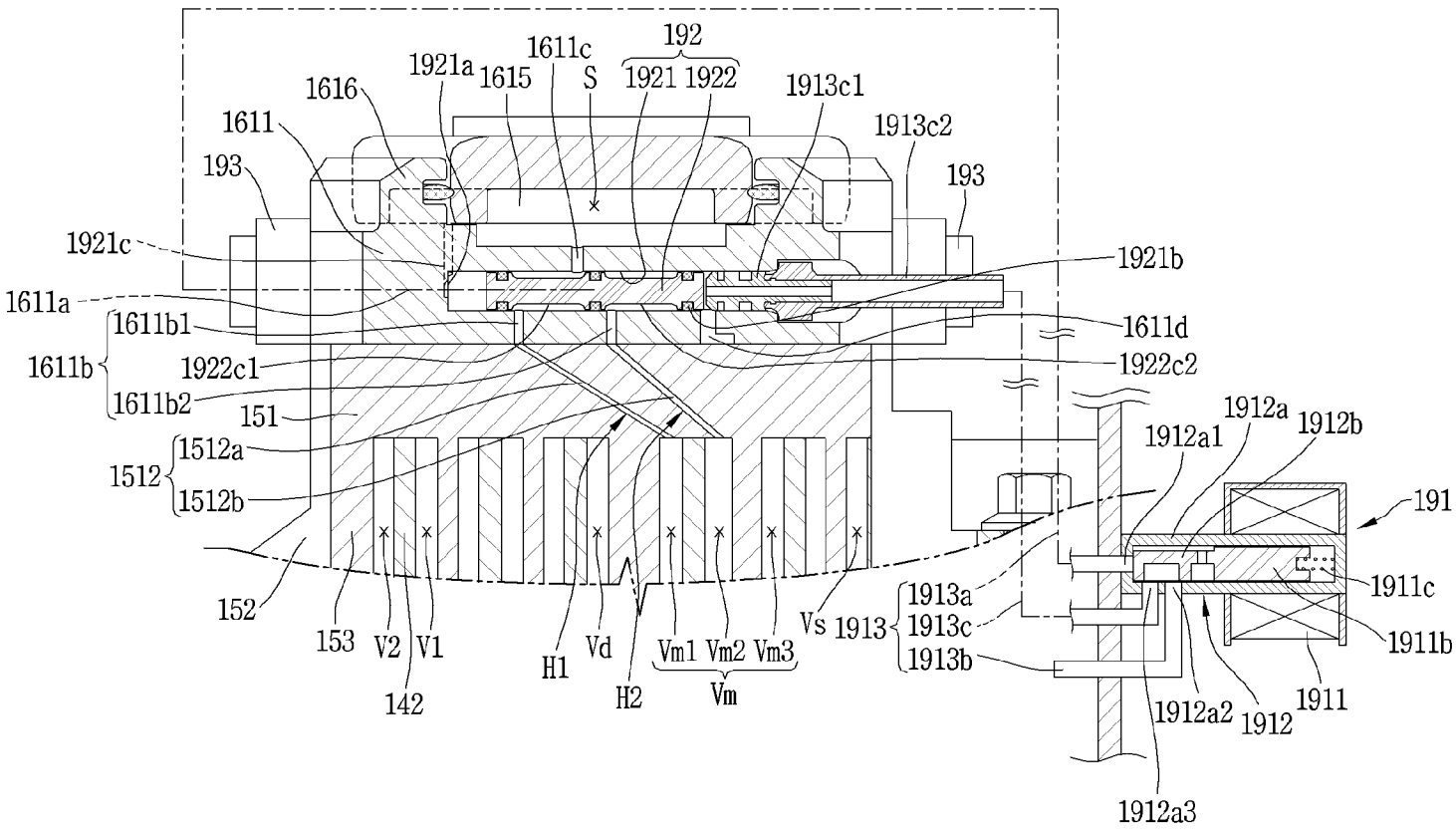
FIG. 3 is a cross-sectional view illustrating an inside of a back pressure switching unit of FIG. 2.
Figure 4:
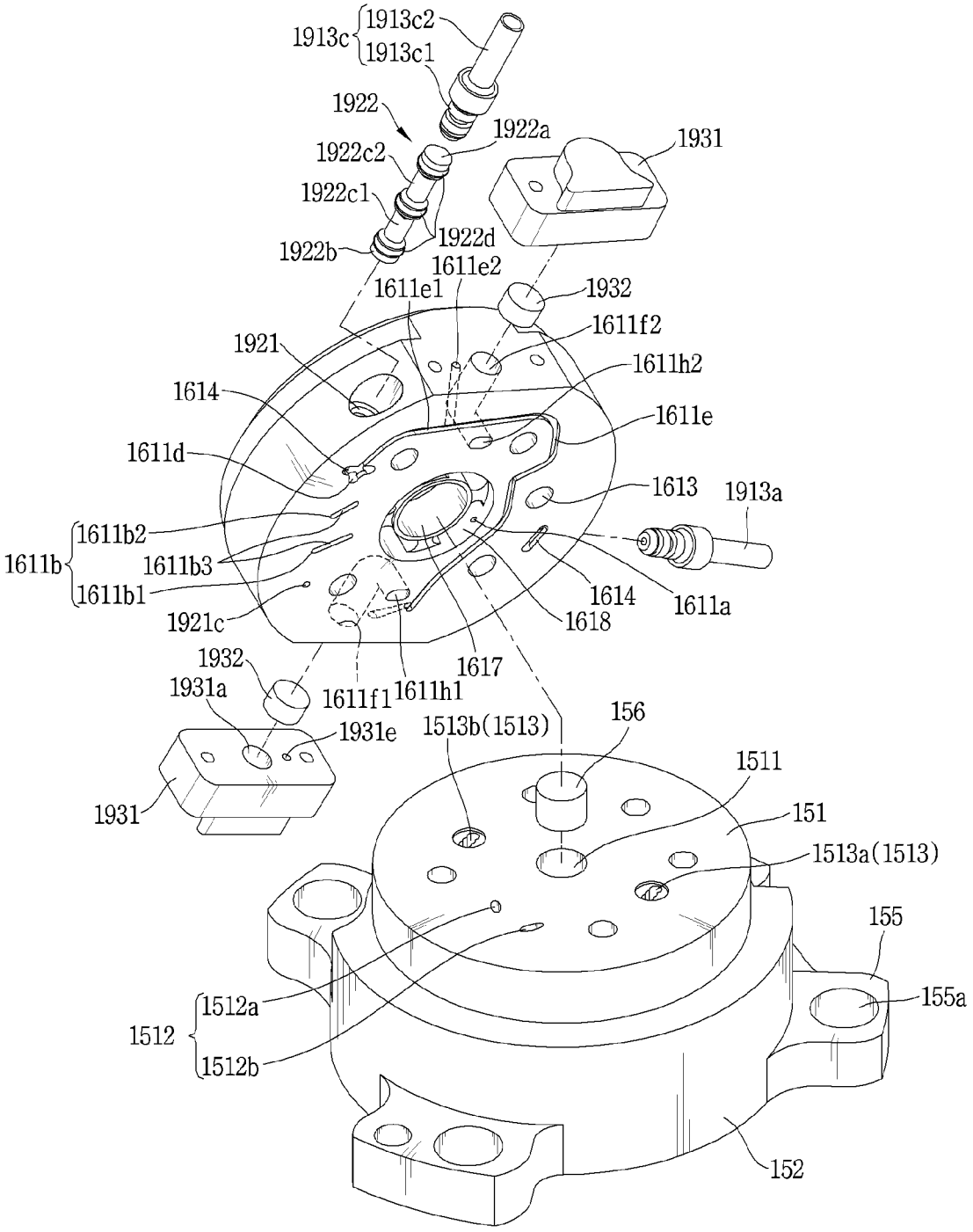
FIG. 4 is an exploded perspective view of a compression unit of FIG. 1.

FIG. 1 is a perspective view illustrating an inside of a capacity-variable scroll compressor in accordance with an embodiment, FIG. 2 is a longitudinal cross-sectional view illustrating an inside of the capacity-variable scroll compressor of FIG. 1. FIG. 3 is a cross-sectional view illustrating an inside of a back pressure switching unit of FIG. 2, and FIG. 4 is an exploded perspective view of a compression unit of FIG. 1.

Referring to FIGS. 1 and 2, in a low-pressure capacity-variable scroll compressor (hereinafter, abbreviated as "scroll compressor") according to an embodiment, a drive motor 120 may be installed in a lower portion of a casing 110, a main frame 130, an orbiting scroll 140, and a non-orbiting scroll 150, and a back pressure chamber assembly 160 may be sequentially installed above the drive motor 120. In general, the drive motor 120 may constitute a motor unit, and the main frame 130, the orbiting scroll 140, the non-orbiting scroll 150, and the back pressure chamber assembly 160 may constitute a compression unit. The motor unit may be coupled to one or a first end of a rotational shaft 125, and the compression unit may be coupled to another or a second end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted to an inner circumferential surface of the cylindrical shell 111 in an inserting manner. A terminal bracket **120*a* may be coupled to an upper portion of the cylindrical shell 111, and a terminal (not shown) that transmits external power to the drive motor 120 may be coupled through the terminal bracket 120*a*. In addition, a refrigerant suction pipe 117 discussed hereinafter may be coupled to the upper portion of the cylindrical shell 111, for example, above the drive motor 120**.

The upper cap 112 may be coupled to cover the open upper end of the cylindrical shell 111, and the lower cap 113 may be coupled to cover the open lower end of the cylindrical shell 111. A rim of a high and low pressure separation plate 115 discussed hereinafter may be inserted between the cylindrical shell 111 and the upper cap 112 and, for example, welded to the cylindrical shell 111 and the upper cap 112, and a rim of a support bracket 116 discussed hereinafter may be inserted between the cylindrical shell 111 and the lower cap 113 to be, for example, welded to the cylindrical shell 111 and the lower cap 113. Accordingly, the inner space of the casing 110 may be sealed.

The rim of the high and low pressure separation plate 115, as discussed above, may be, for example, welded to the casing 110 and a central portion of the high and low pressure separation plate 115 may be bent into a truncated conic shape to protrude toward the upper cap 112 so as to be disposed above the back pressure chamber assembly 160 discussed hereinafter. The refrigerant suction pipe 117 may communicate with a space below the high and low pressure separation plate 115, and a refrigerant discharge pipe 118 may communicate with a space above the high and low pressure separation plate 115. Accordingly, a low-pressure portion 110*a* constituting a suction space may be formed below the high and low pressure separation plate 115, and a high-pressure portion 110*b* constituting a discharge space may be formed above the high and low pressure separation plate 115.

In addition, a through hole 115*a* may be formed through a center of the high and low pressure separation plate 115, and a sealing plate 1151 to which a floating plate 165 discussed hereinafter may be detachably coupled may be inserted into the through hole 115*a*. Accordingly, the low-pressure portion 110*a* and the high-pressure portion 110*b* may be blocked from or communicate with each other by the floating plate 165 and the sealing plate 1151.

The sealing plate 1151 may be formed in an annular shape. For example, a high and low pressure communication hole 1151*a* may be formed through a center of the sealing plate 1151 so that the low-pressure portion 110*a* and the high-pressure portion 110*b* communicate with each other. The floating plate 165 may be attachable and detachable along a circumference of the high and low pressure communication hole 1151*a*. Accordingly, the floating plate 165 may be attached to or detached from the circumference of the high and low pressure communication hole 1151*a* of the sealing plate 1151 while moving up and down by back pressure in an axial direction. During this process, the low-pressure portion 110*a* and the high-pressure portion 110*b* may be sealed from each other or communicate with each other.

In addition, the lower cap 113 may define an oil storage space 110*c* together with the lower portion of the cylindrical shell 111 constituting the low-pressure portion 110*a*. In other words, the oil storage space 110*c* may be defined in the lower portion of the low-pressure portion 110*a*. The oil storage space 110*c* may define a portion of the low-pressure portion 110*a*.

Hereinafter, the drive motor will be described.

Referring to FIGS. 1 and 2, the drive motor 120 according to an embodiment may be disposed under the low-pressure portion 110*a* and include a stator 121 and a rotor 122. The stator 121 may be, for example, shrink-fitted to an inner wall surface of the cylindrical shell 111, and the rotor 122 may be rotatably provided inside of the stator 121.

The stator 121 may include a stator core 1211 and a stator coil 1212. The stator core 1211 may be formed in a cylindrical shape and may be, for example, shrink-fitted onto the inner circumferential surface of the cylindrical shell 111. The stator coil 1212 may be wound around the stator core 1211 and may be electrically connected to an external power source through a terminal (no reference numeral) coupled through the casing 110.

The rotor 122 may include a rotor core 1221 and permanent magnets 1222. The rotor core 1221 may be formed in a cylindrical shape, and may be rotatably inserted into the stator core 1211 with a preset or predetermined gap therebetween. The permanent magnets 1222 may be embedded in the rotor core 1221 at preset or predetermined intervals along a circumferential direction.

The rotational shaft 125 may be coupled to a center of the rotor 122. An upper end portion of the rotational shaft 125 may be rotatably inserted into the main frame 130 discussed hereinafter so as to be supported in a radial direction, and a lower end portion of the rotational shaft 125 may be rotatably inserted into the support bracket 116 so as to be supported in the radial and axial directions. The main frame 130 may be provided with a main bearing 171 that supports the upper end portion of the rotational shaft 125, and the support bracket 116 may be provided with a sub bearing 172 that supports the lower end portion of the rotational shaft 125. The main bearing 171 and the sub bearing 172 each may be configured as a bush bearing.

An eccentric portion 1251 that is eccentrically coupled to the orbiting scroll 140 discussed hereinafter may be formed on the upper end portion of the rotational shaft 125, and an oil feeder 1252 that absorbs oil stored in the lower portion of the casing 110 may be disposed in the lower end portion of the rotational shaft 125. An oil supply hole 1253 may be formed through the rotational shaft 125 in the axial direction.

Next, the main frame will be described.

The main frame 130 according to this embodiment may be disposed above the drive motor 120 and may be, for example, shrink-fitted or welded to an inner wall surface of the cylindrical shell 111. Accordingly, the main frame 130 may be formed of cast iron, for example.

Referring to FIGS. 1 and 2, the main frame 130 may include a main flange portion 131, a main bearing portion 132, an orbiting space portion 133, a scroll support portion 134, an Oldham ring accommodation portion 135, and a frame fixing portion 136. The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 discussed hereinafter may protrude from the outer circumferential surface of the main flange portion 131 in the radial direction, and an outer circumferential surface of the frame fixing portion 136 may be brought into close contact with and fixed to the inner circumferential surface of the casing 110. Accordingly, the main frame 130 may be fixedly coupled to the casing 110.

The main bearing portion 132 may protrude downward from a lower surface of a central portion of the main flange portion 131 toward the drive motor 120. The main bearing portion 132 may be provided with a cylindrical bearing hole 132*a* formed therethrough in the axial direction, and the main bearing 171 configured as the bush bearing may be fixedly coupled to an inner circumferential surface of the bearing hole 132 in an inserted manner. The rotational shaft 125 may be inserted into the main bearing 171 to be supported in the radial direction.

The orbiting space portion 133 may be recessed from the central portion of the main flange portion 131 toward the main bearing portion 132 with a predetermined depth and outer diameter. The orbiting space portion 133 may be formed to be larger than an outer diameter of a rotational shaft coupling portion 143 provided on the orbiting scroll 140 discussed hereinafter. Accordingly, the rotational shaft coupling portion 143 may be pivotally accommodated in the orbiting space portion 133.

The scroll support portion 134 may be formed in an annular shape on an upper surface of the main flange portion 131 along a periphery of the orbiting space portion 133. Accordingly, the scroll support portion 134 may support a lower surface of an orbiting end plate 141 discussed hereinafter in the axial direction.

The Oldham ring accommodation portion 135 may be formed in an annular shape on an upper surface of the main flange portion 131 along an outer circumferential surface of the scroll support portion 134. Accordingly, an Oldham ring 180 may be inserted into the Oldham ring accommodation portion 135 to be pivotable.

The frame fixing portion 136 may be formed to extend radially from an outer periphery of the Oldham ring accommodation portion 135. The frame fixing portion 136 may extend in an annular shape or may extend to form a plurality of protrusions spaced apart from one another at preset or predetermined intervals. This embodiment illustrates an example in which the frame fixing portion 136 includes a plurality of protrusions along the circumferential direction.

For example, a plurality of the frame fixing portion 136 may be provided disposed at preset or predetermined intervals along the circumferential direction. The plurality of frame fixing portions 136 may be provided with bolt coupling holes 136*a*, respectively, that are formed therethrough in the axial direction.

The frame fixing portions 136 may correspond to respective guide protrusions 155 of non-orbiting scroll 150 discussed hereinafter in the axial direction, and the bolt coupling holes 136*a* may be formed to correspond to respective guide insertion holes 155*a* provided in the guide protrusions 155 in the axial direction.

An inner diameter of the bolt coupling hole 136*a* may be smaller than an inner diameter of guide insertion hole 155*a*. Accordingly, a stepped surface that extends from an inner circumferential surface of the guide insertion hole 155*a* may be formed on a periphery of an upper surface of the bolt coupling hole 136*a*, and a guide bush 137 that is inserted through the guide insertion hole 155*a* may be placed on the stepped surface so as to be supported on the frame fixing portion 136 in the axial direction.

The guide bush 137 may be formed in a hollow cylindrical shape through which bolt insertion hole 137*a* is formed in the axial direction. Accordingly, each guide bolt 138 may be inserted through the bolt insertion hole 137*a* of the guide bush 137 to be coupled to the bolt coupling hole 136*a* of the frame fixing portion 136. The non-orbiting scroll 150 may thus be slidably supported on the main frame 130 in the axial direction and fixed to the main frame 130 in the radial direction.

Hereinafter, the orbiting scroll will be described.

Referring to FIG. 2, the orbiting scroll 140 according to this embodiment may be disposed on an upper surface of the main frame 130. Accordingly, it may be advantageous in terms of motor efficiency that the orbiting scroll 140 is formed of a hard material, such as aluminum. In addition, as it is formed of a different material from the main frame 130, which may be cast iron, it may be advantageous in terms of wear resistance.

The orbiting scroll 140 may include orbiting end plate 141, an orbiting wrap 142, and rotational shaft coupling portion 143. The orbiting end plate 141 may be formed approximately in a disk shape. An outer diameter of the orbiting end plate 141 may be mounted on the scroll support portion 134 of the main frame 130 to be supported in the axial direction.

The orbiting wrap 142 may be formed in a spiral shape that protrudes from an upper surface of the orbiting end plate 141 facing the non-orbiting scroll 150 by a preset or predetermined height. The orbiting wrap 142 may be formed to correspond to a non-orbiting wrap 153 to perform an orbiting motion by being engaged with the non-orbiting wrap 153 of the non-orbiting scroll 150 discussed hereinafter. The orbiting wrap 142 may define a compression chamber V together with the non-orbiting wrap 153.

The compression chamber V may be divided into a first compression chamber V1 and a second compression chamber V2 by the non-orbiting wrap 153 discussed hereinafter. The first compression chamber V1 may be formed at an outer surface of the non-orbiting wrap 153, and the second compression chamber V2 may be formed at an inner surface of the non-orbiting wrap 153. The first compression chamber V1 and the second compression chamber V2 each may each include a suction pressure chamber Vs, an intermediate pressure chamber Vm, and a discharge pressure chamber Vd which are consecutively formed (see FIG. 3).

The rotational shaft coupling portion 143 may protrude from a lower surface of the orbiting end plate 141 toward the main frame 130. The rotational shaft coupling portion 143 may be formed in a cylindrical shape, and an eccentric portion bearing 173 may be coupled to an inner circumferential surface of the rotational shaft coupling portion 143 in an inserted manner. The eccentric portion bearing 173 may be configured as a bush bearing.

A length of the rotational shaft coupling portion 143 may be shorter than a depth of the orbiting space portion 133, and an outer diameter of the rotational shaft coupling portion 143 may be smaller than an inner diameter of the orbiting space portion 133 by at least twice of an orbiting radius. Accordingly, the rotational shaft coupling portion 143 may perform the orbiting motion while being accommodated in the orbiting space portion 133.

The Oldham ring 180 may be provided between the main frame 130 and the orbiting scroll 140 to restrict a rotational motion of the orbiting scroll 140. As described above, the Oldham ring 180 may be slidably coupled to each of the main frame 130 and the orbiting scroll 140, or slidably coupled to each of the orbiting scroll 140 and the non-orbiting scroll 150.

Hereinafter, the non-orbiting scroll will be described.

Referring to FIGS. 2 to 4, the non-orbiting scroll 150 according to this embodiment may be disposed on the orbiting scroll 140 to define compression chamber V together with the orbiting scroll 140. Accordingly, it may be advantageous in terms of wear resistance that the non-orbiting scroll 150 is formed of cast iron which is different from the material forming the orbiting scroll 140.

The non-orbiting scroll 150 may be fixedly coupled to the main frame 130 at the low-pressure portion 110*a* of the casing 110, or may be coupled to the main frame 130 to be movable up and down with respect to the main frame 130. In this embodiment, the non-orbiting scroll 150 is coupled to the main frame 130 to be axially movable with respect to the main frame 130.

The non-orbiting scroll 150 may include a non-orbiting end plate 151, a non-orbiting side wall 152, and the non-orbiting wrap 153. A discharge port 1511 may be formed at a central portion of the non-orbiting end plate 151, and around the discharge port 1511, there may be formed a compression chamber side back pressure hole 1512 and a capacity variable hole 1513. The discharge port 1511, the compression chamber side back pressure hole 1512, and the capacity variable hole 1513 each may be formed through axially opposite surfaces of the non-orbiting end plate 151.

As the compression chamber side back pressure hole 1512 and the capacity variable hole 1513 communicate with the intermediate pressure chamber Vm discussed hereinafter, the compression chamber side back pressure hole 1512 may form intermediate pressure holes H1 and H2 and the capacity variable hole 1513 may form an intermediate pressure hole H3. More particularly, the compression chamber side back pressure hole 1512 may include first intermediate pressure hole H1 to communicate with a first intermediate pressure chamber Vm1 and second intermediate pressure hole H2 to communicate with a second intermediate pressure chamber Vm2. Accordingly, a compression chamber side first back pressure hole 1512*a* discussed hereinafter may form the first intermediate pressure hole H1 together with a back pressure chamber side first back pressure hole 1611*b*1, and a compression chamber side second back pressure hole 1512*b* discussed hereinafter may form the second intermediate pressure hole H2 together with a back pressure chamber side second back pressure hole 1611*b*2. Hereinafter, the first intermediate pressure hole H1 may be referred to as a "first back pressure passage", and the second intermediate pressure hole H2 may be referred to as a "second back pressure passage".

In addition, the capacity variable hole 1513 may communicate with a third intermediate pressure chamber Vm3 discussed hereinafter to form a third intermediate pressure hole H3. Accordingly, a capacity variable passage 1611*f* discussed hereinafter that communicates with the capacity variable hole 1513 may also form the third intermediate pressure hole H3. Hereinafter, the third intermediate pressure hole H3 may be referred to as a "capacity variable passage".

The discharge port 1511 may be axially formed through the discharge pressure chamber Vd in the first compression chamber V1 and the second compression chamber V2. Although not illustrated in the drawings, a plurality of the discharge port 1511 may be provided, so that each of the discharge ports 1511 may communicate with the first compression chamber V1 and the second compression chamber V2, respectively.

The compression chamber side back pressure hole 1512 may communicate with the intermediate pressure chamber Vm at an intermediate pressure which is between a suction pressure and a discharge pressure in a vicinity of the discharge port 1511. The compression chamber side back pressure hole 1512 may be formed at a position communicating with back pressure chamber side back pressure hole 1611*b*.

One or a first end of the compression chamber side back pressure hole 1512 may communicate with the intermediate pressure chamber Vm, and another or a second end of the compression chamber side back pressure hole 1512 may communicate with a back pressure switching valve accommodating portion 1921 discussed hereinafter. Accordingly, the compression chamber side back pressure hole 1512 may be axially formed through, but may also be inclined in consideration of adjacent structures, such as a bolt hole (no reference numeral).

The compression chamber side back pressure hole 1512 may be formed as a single hole or a plurality of holes. When the compression chamber side back pressure hole 1512 is formed as a single hole, this may be defined as a single back pressure method. When a plurality of the compression chamber side back pressure hole 1512 is provided, this may be defined as a multiple back pressure method. As this embodiment uses the multiple back pressure method, the non-orbiting end plate 151 according to this embodiment may include a plurality of compression chamber side back pressure holes 1512.

The plurality of compression chamber side back pressure holes 1512 may include the compression chamber side first back pressure hole 1512*a* and the compression chamber side second back pressure hole 1512*b*, and the compression chamber side first back pressure hole 1512*a* and the compression chamber side second back pressure hole 1512*b* each may communicate with the first intermediate pressure chamber Vm1 and the second intermediate pressure chamber Vm2 at different pressures, respectively. This will be described hereinafter together with the back pressure switching unit.

The capacity variable hole 1513 may be formed at a more radially outward position than the compression chamber side back pressure hole 1512 with respect to a movement trajectory of the compression chamber V. For example, one or a first end of the capacity variable hole 1513 may communicate with the third intermediate pressure chamber Vm3 at a pressure lower than that of the first intermediate pressure chamber Vm1 and the second intermediate pressure chamber Vm2.

The capacity variable hole 1513 may include a first capacity variable hole 1513*a* that communicates with the first compression chamber V1 and a second capacity variable hole 1513*b* that communicates with the second compression chamber V2. For example, the first capacity variable hole 1513*a* may communicate with the third intermediate pressure chamber Vm3 of the first compression chamber V1, and the second capacity variable hole 1513*b* may communicate with the third intermediate pressure chamber Vm3 of the second compression chamber V2. Accordingly, the first capacity variable hole 1513*a* and the second capacity variable hole 1513*b* each may communicate with third intermediate pressure chambers Vm3 at a same pressure. This will be described hereinafter together with the capacity variable unit.

The non-orbiting side wall 152 may axially extend in an annular shape from a rim of a lower surface of the non-orbiting end plate 151. An outer diameter of the non-orbiting side wall 152 may be smaller than an inner diameter of the cylindrical shell 111. Accordingly, the non-orbiting scroll 150 of this embodiment may be spaced apart from the inner circumferential surface of the cylindrical shell 111 so as to axially move according to a difference between a pressure in the compression chamber V and a pressure in a back pressure chamber S, which will be described hereinafter.

A height of the non-orbiting side wall 152 may be substantially the same as a height of the non-orbiting wrap 153, and an outer circumferential surface of the non-orbiting side wall 152 may be provided with guide protrusion 155 that extends therefrom in the radial direction. The guide protrusion 155 may have the guide insertion hole 155*a* described above.

A plurality of the guide protrusion 155 may be provided or the guide protrusion 155 may be provided as a single piece. When a plurality of the guide protrusion 155 is provided, the guide protrusions 155 may be disposed at preset or predetermined intervals along the circumferential direction and each of the guide protrusions 155 may have one guide insertion hole 155*a*. When the guide protrusion 155 is provided as a single piece, a plurality of guide insertion holes 155*a* may be formed at preset or predetermined intervals along the circumferential direction. FIG. 4 illustrates a case in which a plurality of the guide protrusion 155 is provided.

One or a first side of the outer circumferential surface of the non-orbiting side wall 152 may be provided with a suction port 1521. One or a first end of the suction port 1521 may communicate with the low-pressure portion 110*a* of the casing 110, and another or a second end of the suction port 1521 may communicate with the suction pressure chamber Vs (herein after, the first compression chamber will be described as a representative example). Accordingly, refrigerant may be suctioned into the low-pressure portion 110*a* of the casing through the refrigerant suction pipe 117, then the refrigerant may be introduced into the suction pressure chamber Vs through the suction port 1521.

The non-orbiting wrap 153 may extend in the axial direction from the lower surface of the non-orbiting end plate 151. The non-orbiting wrap 153 may be formed in a spiral shape at an inner portion of the non-orbiting side wall 152, and formed to correspond to the orbiting wrap 142 so as to be engaged with the orbiting wrap 142. A description of the non-orbiting wrap 153 will replaced with the description of the orbiting wrap 142.

The back pressure chamber assembly 160 according to this embodiment may be installed on an upper surface of the non-orbiting scroll 150, namely, a surface facing the high and low pressure separation plate 115. The back pressure chamber assembly 160 may include back pressure plate 161 and floating plate 165.

The back pressure plate 161 may be fixed to the upper surface of the non-orbiting scroll 150 by, for example, a bolt, and may include a fixed plate portion 1611, an inner wall portion 1615, and an outer wall portion 1616. The fixed plate portion 1611 may be formed in a substantially annular plate shape a center of which is empty, the inner wall portion 1615 may be formed to surround an inner circumference of the fixed plate portion 1611 from a central portion of the upper surface of the fixed plate portion 1611, and the outer wall portion 1616 may be formed to surround an outer circumference of the fixed plate portion 1611 from a rim of the upper surface of the fixed plate portion 1611.

The inner wall portion 1615 and the outer wall portion 1616 may be formed in an annular shape axially protruding by a predetermined height, and the inner wall portion 1615 and the outer wall portion 1616 may be radially spaced apart from each other with a predetermined gap therebetween. Accordingly, an outer circumferential surface of the inner wall portion 1615, an inner circumferential surface of the outer wall portion 1616, and the upper surface of the fixed plate portion 1611 may form an annular back pressure chamber S.

Inside the fixed plate portion 1611, there may be provided a discharge pressure hole 1611*a* formed therethrough in the radial direction. Accordingly, one or a first end of the discharge pressure hole 1611*a* may pass through the inner circumferential surface to communicate with a periphery of an intermediate discharge port 1618, and another or a second end of the discharge pressure hole 1611*a* may pass through the outer circumferential surface so as to be connected with a first connection pipe 1913*a* of mode switching connection portion 1913. This will be described again hereinafter together with the mode switching unit.

Inside the fixed plate portion 1611, there may be formed the back pressure switching valve accommodating portion 1921 forming a portion of a back pressure switching unit 192 in a lateral direction (not in the radial direction), and there may be formed the back pressure chamber side back pressure hole 1611*b* that communicates with the back pressure switching valve accommodating portion 1921.

The back pressure chamber side back pressure hole 1611*b* may be formed to communicate with the compression chamber side back pressure hole 1512 provided in the non-orbiting scroll 150. Accordingly, the back pressure chamber side back pressure hole 1611*b* may include the back pressure chamber side first back pressure hole 1611*b*1 and the back pressure chamber side second back pressure hole 1611*b*2. The back pressure chamber side first back pressure hole 1611*b*1 may communicate with the first intermediate pressure chamber Vm1 through the compression chamber side first back pressure hole 1512*a*, and the back pressure chamber side second back pressure hole 1611*b*2 may communicate with the second intermediate pressure chamber Vm2 through the compression chamber side second back pressure hole 1512*b*. This will be described hereinafter together with the back pressure switching unit.

A plurality of connection grooves 1611*b*3 may be formed on a lower surface of the fixed plate portion 1611. The connection grooves 1611*b*3 provide communication between the back pressure chamber side back pressure hole (precisely, the back pressure switching valve accommodating portion) 1611*b* and the compression chamber side back pressure hole 1512. Accordingly, even if the back pressure switching valve accommodating portion 1921, which will be described hereinafter, cannot be formed in a straight line in the axial direction with respect to the compression chamber side back pressure hole 1512 due to a bolt hole, for example, the connection grooves 1611*b*3 may be formed to be elongated in a lateral direction to communicate the compression chamber side back pressure hole 1512 with the back pressure chamber side back pressure hole 1611*b* through the back pressure switching valve accommodating portion 1921.

A back pressure chamber side common back pressure hole 1611*c* may be formed inside of the fixed plate portion 1611 that provides communication between the back pressure switching valve accommodating portion 1921 discussed hereinafter and the back pressure chamber S. The back pressure chamber side common back pressure hole 1611*c* may be formed between the back pressure chamber side first back pressure hole 1611*b*1 and the back pressure chamber side second back pressure hole 1611*b*2, and may communicate with the back pressure chamber side first back pressure hole 1611*b*1 or the back pressure chamber side second back pressure hole 1611*b*2 due to a back pressure switching valve 1922 discussed hereinafter. Accordingly, the back pressure chamber side common back pressure hole 1611*c* may form a kind of common intermediate pressure hole, and the back pressure chamber S may communicate with the first intermediate pressure chamber Vm1 or the second intermediate pressure chamber Vm2 through the back pressure chamber side common back pressure hole 1611*c* forming the common intermediate pressure hole. This will be described hereinafter together with the back pressure switching unit.

A mode switching hole 1611*d* may be formed inside of the fixed plate portion 1611. The mode switching hole 1611*d* may be connected to capacity variable unit 193 to open and close the capacity variable unit 193, which will be described hereinafter.

The mode switching hole 1611*d* may communicate with the back pressure switching valve accommodating portion 1921 discussed hereinafter, and may be positioned between the back pressure chamber side second back pressure hole 1611*b*2 and a third connection pipe 1913*c*. Accordingly, the mode switching hole 1611*d* may be opened in the power operation mode in which a discharge pressure is provided to the back pressure switching valve accommodating portion 1921 through the third connection pipe 1913*c*, and may be closed in the saving operation mode in which a suction pressure is provided. This will be described hereinafter together with the capacity variable unit.

A mode switching passage 1611*e* may be formed in the fixed plate portion 1611. The mode switching passage 1611*e* may provide communication between the mode switching hole 1611*d* and an injection hole 1931*e* of the capacity variable unit 193 discussed hereinafter.

More specifically, one or a first end of the mode switching passage 1611*e* may communicate with the mode switching hole 1611*d* and be formed at a lower surface of the fixed plate portion 1611, and another or a second end of the mode switching passage 1611*e* may be formed through an outer circumferential surface of the fixed plate portion 1611. For example, a valve fixing surface 1612 may be formed at each of opposite sides of the outer circumferential surface of the fixed plate portion 1611, and the first end and the second end of the mode switching passage 1611*e* may be respectively formed through each of the valve fixing surfaces 1612 from the lower surface of the fixed plate portion 1611. This will be described hereinafter together with the capacity variable unit.

A first capacity variable passage 1611*f*1 and a second capacity variable passage 1611*f*2 may be formed in the fixed plate portion 1611. The first capacity variable passage 1611*f*1 may communicate with the first capacity variable hole 1513*a* formed in the non-orbiting scroll 150, and the second capacity variable passage 1611*f*2 may communicate with the second capacity variable hole 1513*b* formed in the non-orbiting scroll 150. Accordingly, the first capacity variable passage 1611*f*1 and the second capacity variable passage 1611*f*2 may have a phase difference of approximately 180° with respect to each other.

More specifically, the first capacity variable passage 1611*f*1 and the second capacity variable passage 1611*f*2 may penetrate from the lower surface to the outer circumferential surface of the fixed plate portion 1611. For example, one or a first end of the first capacity variable passage 1611*f*1 and one or a first end of the second capacity variable passage 1611*f*2 each may communicate with the first capacity variable hole 1513*a* and the second capacity variable hole 1513*b*, respectively. Another or a second end of the first capacity variable passage 1611*f*1 and another or a second end of the second capacity variable passage 1611*f*2 may be formed through each of the valve fixing surfaces 1612 at opposite sides. This will be described hereinafter together with the capacity variable unit.

The inner wall portion 1615 according to this embodiment may be formed in an annular shape as described above, a discharge valve accommodating portion 1617 may be formed at an inner side of the inner wall portion 1615*a*, and a discharge valve 156 may be slidably inserted into the discharge valve accommodating portion 1617.

A backflow prevention hole 1617*a* may be formed on an upper surface of the discharge valve accommodating portion 1617. The backflow prevention hole 1617*a* may be formed through the upper surface of the discharge valve accommodating portion 1617 to provide communication between an inner portion of the discharge valve accommodating portion 1617 and the high-pressure portion 110*b* of the casing 110. Accordingly, during operation, the discharge valve 156 may be pushed upward by refrigerant discharged through the discharge port 1511 to open the discharge port 1511, while at stoppage, the discharge valve 156 may be pushed downward by refrigerant flowing backward through the backflow prevention hole 1617*a* to block the discharge port 1511.

The intermediate discharge port 1618 may be formed around the discharge valve accommodating portion 1617 and communicates with the discharge port 1511. More specifically, a plurality of the intermediate discharge port 1618 may be formed along the circumferential direction, and a lower end of the intermediate discharge port 1618 may communicate with the discharge port 1511 while an upper end thereof may communicate with the high-pressure portion 110*b* of the casing 110. Accordingly, when the discharge valve 156 is opened, refrigerant discharged through the discharge port 1511 may be discharged to the high-pressure portion 110*b* of the casing 110 through the intermediate discharge port 1618.

The outer wall portion 1616 according to this embodiment may be formed in an annular shape as described above, and may be spaced apart from the outer circumferential surface of the inner wall portion 1615 with a predetermined gap therebetween. Accordingly, the outer wall portion 1616 and the inner wall portion 1615 may form side surfaces of the back pressure chamber, and the floating plate 165 may be slidably inserted into a space between the outer wall portion 1616 and the inner wall portions 1615.

Referring to FIGS. 3 and 4, the floating plate 165 may be slidably inserted between the outer circumferential surface of the inner wall portion 1615 and the inner circumferential surface of the outer wall portion 1616. Accordingly, a lower surface of the floating plate 165 may form an upper surface of the back pressure chamber S described above.

Although not illustrated in the drawings, the floating plate 165 may be slidably fitted to an inner circumferential surface of the inner wall portion 1615 and an outer circumferential surface of the outer wall portion 1616, or may be slidably fitted to the outer circumferential surface of the inner wall portion 1615 and the inner circumferential surface of the outer wall portion 1616. In either of these cases, the lower surface of the floating plate 165 may form the upper surface of the back pressure chamber S described above.

A central portion of an upper surface of the floating plate 165 may be provided with a sealing protrusion 1651. The sealing protrusion 1651 may be formed to protrude upward from the surface of the floating plate 165, and an inner diameter of the sealing protrusion 1651 may be formed in a size so as not to cover the intermediate discharge port 1618. The sealing protrusion 1651 may be brought into contact with a lower surface of the sealing plate 1151 or the high and low pressure separation plate 115 described above to block discharged refrigerant, so that the discharged refrigerant is discharged to the high-pressure portion 110*b* without being leaked to the low-pressure portion 110*a*.

It is advantageous for the floating plate 165 to be formed of a material as light as possible so that the floating plate 165 may move up or down according to a change in back pressure during operation or stoppage of the compressor. For example, the floating plate 165 may be formed of engineering plastics. However, as the floating plate 165 collides with the sealing plate 1151 of the high and low pressure separation plate 115 while moving up in the axial direction during operation of the compressor, it may be advantageous for the floating plate 165 to be formed of a metal material as light as possible in terms of reliability. For example, the floating plate 165 may be formed of a surface-treated aluminum material.

A first back pressure sealing member 1661 may be provided between an inner circumferential surface of the floating plate 165 and the outer circumferential surface of the inner wall portion 1615, and a second back pressure sealing member 1662 may be provided between an outer circumferential surface of the floating plate 165 and the inner circumferential surface of the outer wall portion 1616. For example, an annular first sealing groove (no reference numeral) may be formed on the inner circumferential surface of the floating plate 165 and an annular second sealing groove (no reference numeral) may be formed on the inner circumferential surface of the outer wall portion 1616 of the back pressure plate 161. The first back pressure sealing member 1661 formed in an annular shape like an O-ring may be inserted into the first sealing groove, and the second back pressure sealing member 1662 formed in an annular shape like an O-ring may be inserted into the second sealing groove. Accordingly, the back pressure chamber S may be tightly sealed by the first back pressure sealing member 1661 and the second back pressure sealing member 1662.

In the drawings, reference numeral 1613 denotes a bolt hole for fastening the back pressure plate to the non-orbiting scroll, and reference numeral 1614 denotes a pin hole for fixing the connection pipe to the back pressure plate.

The scroll compressor according to this embodiment may operate as follows.

During operation of the compressor, power is applied to the stator coil 1212 of the stator 121 to rotate the rotor 122 and the rotational shaft 125. Then, the orbiting scroll 140 coupled to the rotational shaft 125 may perform the orbiting motion with respect to the non-orbiting scroll 150, thereby forming the first compression chamber V1 and the second compression chamber V2 between the orbiting wrap 142 and the non-orbiting wrap 153.

The first compression chamber V1 and the second compression chamber V2 may gradually decrease in volume while moving from outside to inside according to the orbiting motion of the orbiting scroll 140. Then, the refrigerant may be suctioned into the low pressure portion 110*a* of the casing 110 through the refrigerant suction pipe 117. A portion of the refrigerant may be suctioned directly into each of the suction pressure chambers Vs forming the first compression chamber V1 and the second compression chamber V2, respectively, while the rest of the refrigerant may first flow toward the drive motor 120 and then be suctioned into the suction pressure chambers Vs.

The refrigerant suctioned into the first compression chamber V1 and the second compression chamber V2 may be compressed while moving along the path of the first compression chamber V1 and the second compression chamber V2 toward the discharge pressure chamber Vd, and the refrigerant compressed in each of the compression chambers V1 and V2 may be discharged from the discharge pressure chamber Vd while pushing the discharge valve 156. The refrigerant may then be discharged to the high-pressure portion 110*b* of the casing 110 through the discharge port 1511 and the intermediate discharge port 1618, and the refrigerant discharged to the high-pressure portion 110*b* may be discharged to a condenser of a refrigeration cycle through the refrigerant discharge pipe 118. This series of processes may be repeatedly performed.

On the other hand, when the compressor is stopped, as the pressure in the back pressure chamber S decreases, the floating plate 165 may move downward toward the fixed plate portion 1611 of the back pressure plate 161. Then, the sealing protrusion 1651 of the floating plate 165 may be spaced apart from the sealing plate 1151 of the high and low pressure separation plate 115 to allow the low-pressure portion 110*a* and the high-pressure portion 110*b* to communicate with each other. Then, the refrigerant in the high-pressure portion 110*b* may leak into the low-pressure portion 110*a* to achieve a flat pressure between the high-pressure portion 110*b* and the low-pressure portion 110*a* which forms the inner space of the casing 110.

At this time, the discharge valve 156 may also be pushed down by the refrigerant from the high-pressure portion 110*b* to block the discharge port 1511. This may block a reverse flow of the refrigerant from the high-pressure portion 110*a* into the compression chamber V.

In the capacity variable scroll compressor, the operation mode of the compressor may be switched to a full load operation (hereinafter, a "power operation") or a partial load operation (or a "saving operation"). For example, the capacity variable scroll compressor may be provided with a capacity variable passage (or a bypass passage) in a middle section of the compression chamber that opens and closes depending on the operation mode, so that in the power operation, the entire compression section may be utilized to increase compression capacity, while in the saving operation, the compression section may be reduced to lower the compression capacity.

When the back pressure in the back pressure chamber is constant regardless of the operation mode of the compressor, too much back pressure may be generated in the power operation, and conversely, insufficient back pressure may be generated in the saving mode. In other words, a relatively low back pressure (or second intermediate pressure) may be needed in the power operation, and a relatively high back pressure (or first intermediate pressure) may be needed in the saving operation. With this reason, in the capacity variable scroll compressor, it is advantageous in terms of compression efficiency that the back pressure also varies according to the operation mode. Accordingly, a capacity variable and back pressure switching type scroll compressor as in this embodiment may be provided.

Figure 5:
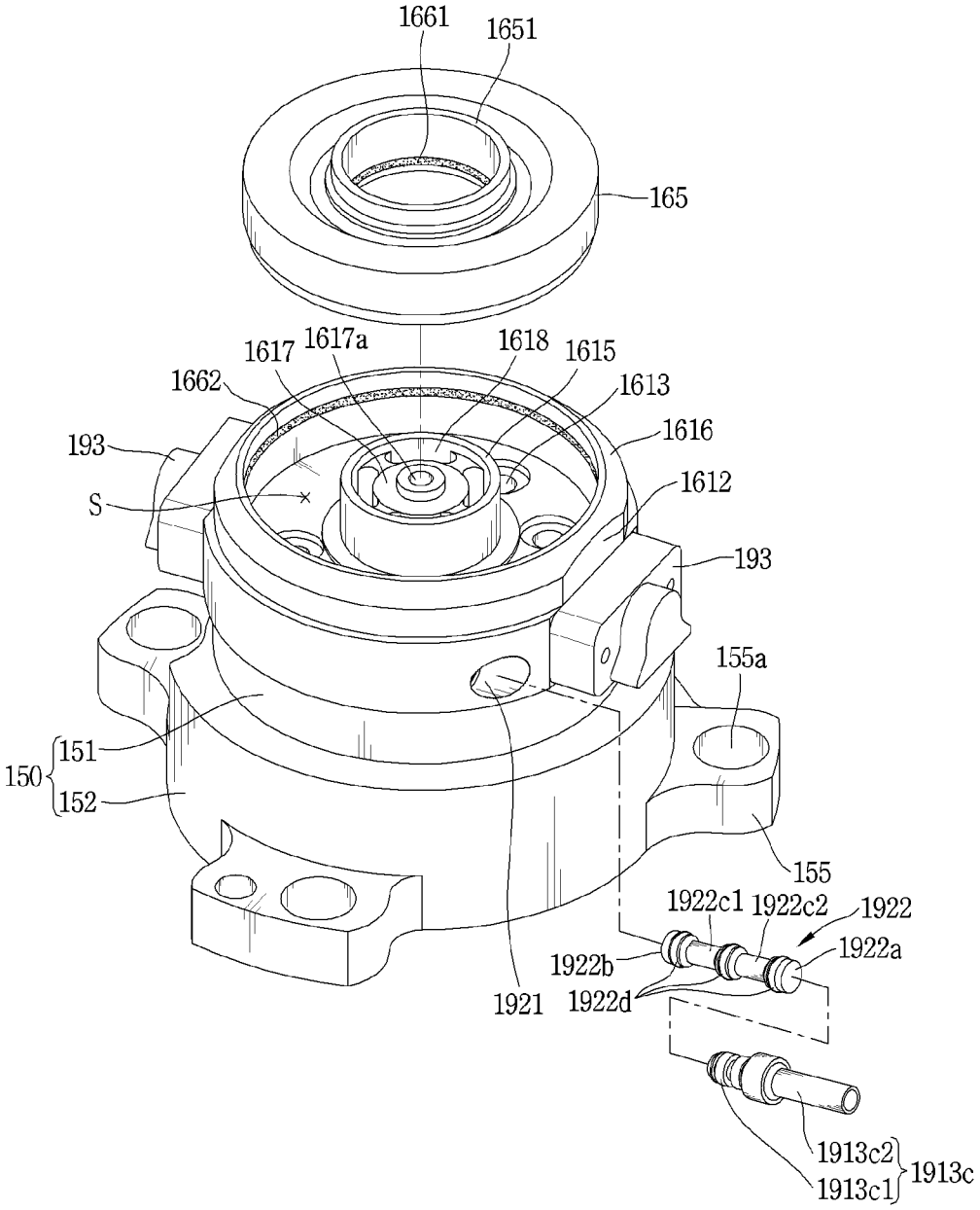
FIG. 5 is an assembled perspective view of the compression unit of FIG. 4.
Figure 6:
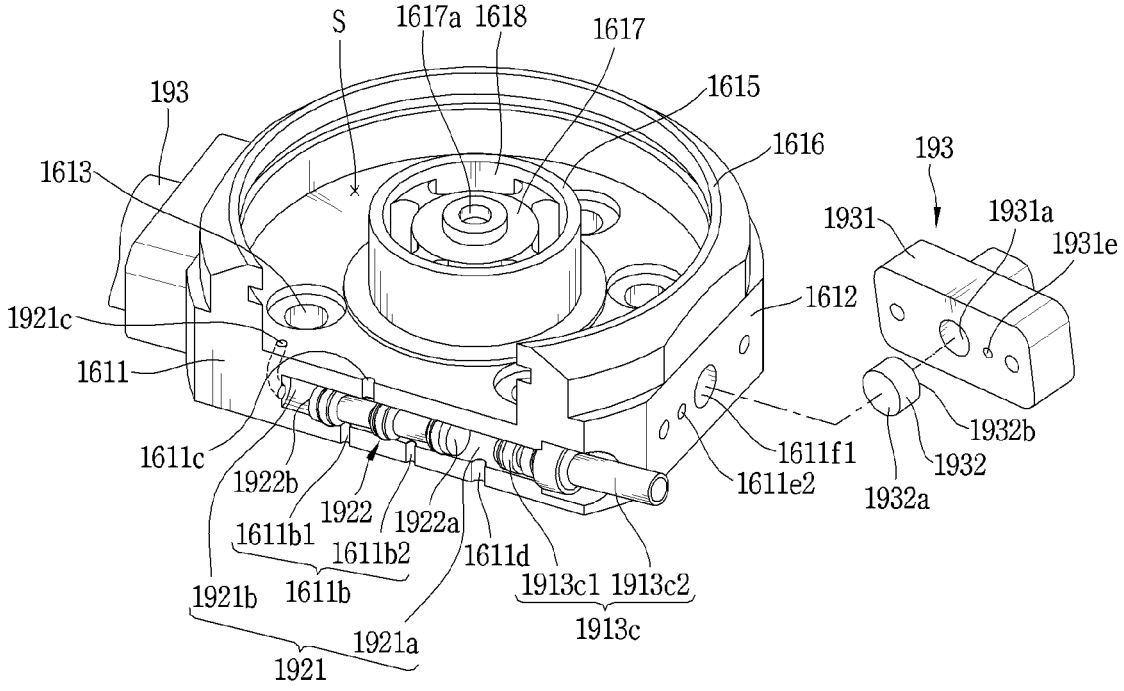
FIG. 6 is a cut perspective view illustrating a back pressure plate of FIG. 5 where a back pressure switching unit is cut.
Figure 7:
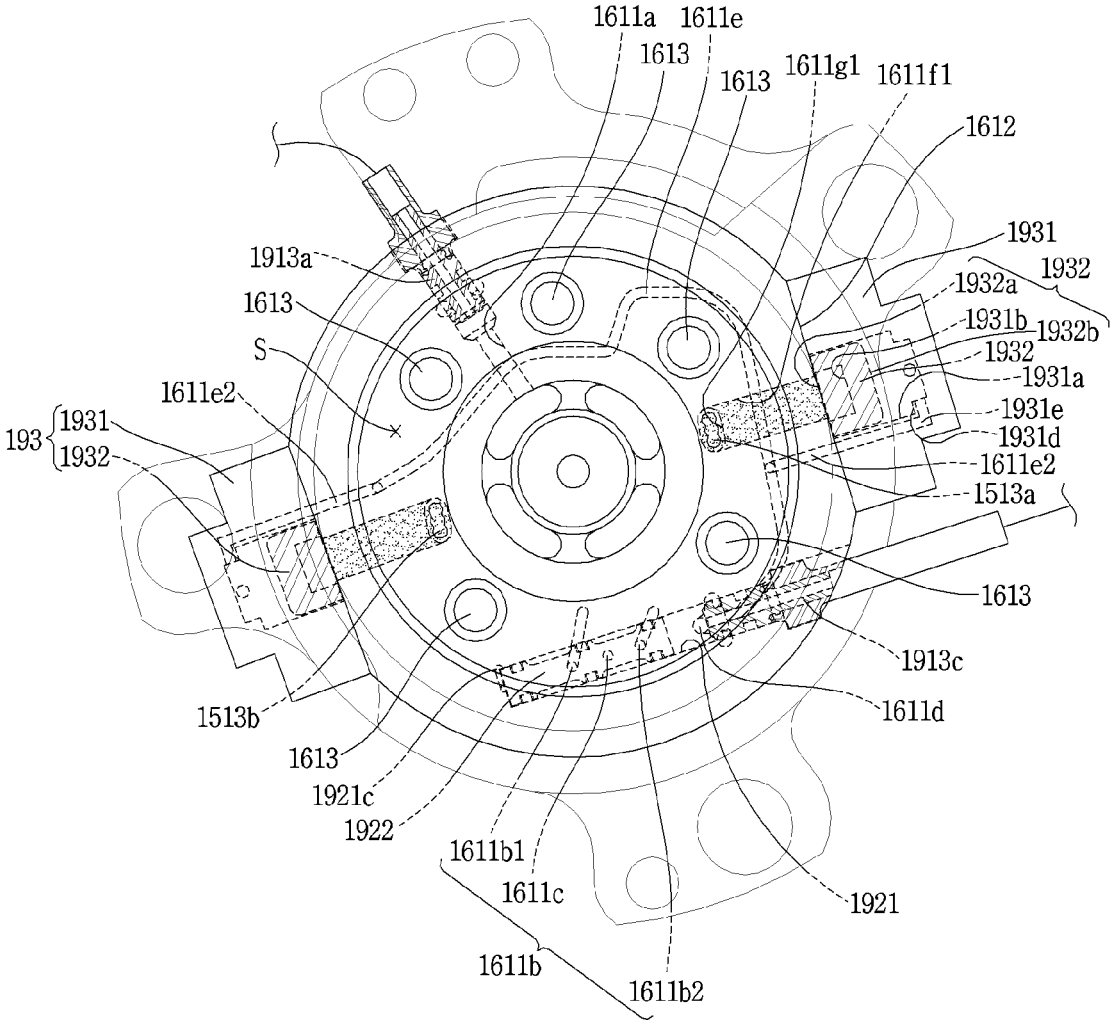
FIG. 7 is a planar view of the compression unit of FIG. 4 viewed from the top.

FIG. 5 is an assembled perspective view of the compression unit of FIG. 4. FIG. 6 is a cut perspective view illustrating a back pressure plate of FIG. 5 where a back pressure switching unit is cut, and FIG. 7 is a planar view of the compression unit of FIG. 4 viewed from the top.

Referring back to FIGS. 2 and 3, the capacity variable and back pressure switching type scroll compressor according to this embodiment may include a mode switching unit 191 configured to switch the operation mode of compressor, back pressure switching unit 192 configured to convert the pressure in the back pressure chamber S to an appropriate back pressure according to the switching of the operation mode, and capacity variable unit 193 configured to change the mode to the full load operation or the partial load operation according to the switching of the operation mode. The back pressure switching unit 192 and the capacity variable unit 193 according to this embodiment may be connected in series or connected in parallel by the mode switching unit 191. For example, the mode switching unit 191, the back pressure switching unit 192, and the capacity variable unit 193 may be connected in series in the order of the mode switching unit 191, the back pressure switching unit 192, and the capacity variable unit 193, or in the order of the mode switching unit 191, the capacity variable unit 193, and the back pressure switching unit 192. Alternatively, the mode switching unit 191, the back pressure switching unit 192, and the capacity variable unit 193 may be connected in parallel in the order of the mode switching unit 191, the back pressure switching unit 192, and the capacity variable unit 193. Hereinafter, an example in which the mode switching unit, the back pressure switching unit, and the capacity variable unit are connected in series in the order will be described.

First, the mode switching unit will be described.

Referring back to FIGS. 2 and 3, the mode switching unit 191 according to this embodiment is a valve for selecting the power operation or the saving operation, and may also be referred to as an "operation control valve". For example, the mode switching unit 191 may be configured as a solenoid valve for switching the operation mode of the compressor to the power operation mode and the saving operation mode while moving between a first position and a second position depending on whether power is applied.

The mode switching unit 191 may be fixedly coupled to an outer circumferential surface of the casing 110 using a fixing bracket 191*a*. However, in some cases, the mode switching unit 191 may be coupled to the outer circumferential surface of the casing 110 by, for example, welding without using a separate fixing bracket. In this way, the mode switching unit 191 may be installed outside of the casing 110 to facilitate installation and maintenance of the mode switching unit 191.

The mode switching unit 191 according to this embodiment may include a valve power supply 1911, a mode switching valve portion 1912, and mode switching connection portion 1913. The valve power supply 1911 may be connected to an external power source to allow valve actuator 1911*b* to be selectively operated depending on whether the external power is applied. More specifically, the valve power supply 1911 may be provided with the valve actuator 1911*b* inside of valve coil 1911*a* to which power is applied, and valve return spring 1911*c* may be provided at one or a first end of the valve actuator 1911*b*. At another or a second end of the valve actuator 1911*b*, a mode switching valve 1912*b* discussed hereinafter may be integrally formed or assembled thereto.

The mode switching valve portion 1912 may be provided at one or a first side of the valve power supply 1911. The mode switching valve portion 1912 may include the mode switching valve 1912*b* described above, and may be configured to change a flow direction of the refrigerant while operated by the valve power supply 1911.

For example, the mode switching valve portion 1912 may be configured as a reciprocating type valve or a rotary type valve depending on a shape of the mode switching valve 1912*b*. The former is a method of changing the flow of refrigerant by a valve body reciprocating inside of a valve housing, and the latter is a method of changing the flow of refrigerant by the valve body rotating inside of the valve housing. In this embodiment, the reciprocating type valve will be described.

The mode switching valve portion 1912 according to this embodiment may include a valve housing 1912*a* and the mode switching valve 1912*b*. The valve housing 1912*a* may be coupled to the outer circumferential surface of the casing 110 by, for example, welding or bolting. The valve housing 1912*a* may be formed, for example, in a long cylindrical shape and have three inlet and outlets along a lengthwise direction.

A first inlet and outlet 1912*a*1 may be connected to the discharge pressure hole 1611*a* through discharge pressure side connection pipe (hereinafter, first connection pipe) 1913*a* discussed hereinafter, a second inlet and outlet 1912*a*2 may be connected to the low-pressure portion 110*a* of the casing 110 through suction pressure side connection pipe (hereinafter, "second connection pipe") 1913*b* discussed hereinafter, and a third inlet and outlet 1912*a*3 may be connected to the back pressure switching valve accommodating portion 1921 of the back pressure switching unit 192 discussed hereinafter through common side connection pipe (hereinafter, "third connection pipe") 1913*c* discussed hereinafter.

The mode switching valve 1912*b* may be formed in a bar shape to be slidably inserted in the valve housing 1912*a*. One or a first end of the mode switching valve 1912*b* may extend from the valve actuator 1911*b* of the valve power supply 1911 described above, and another or a second end of the mode switching valve 1912*b* may have a plurality of connection passages (no reference numeral) to selectively interconnect the first inlet and outlet 1912*a*1, the second inlet and outlet 1912*a*2, and the third inlet and outlet 1912*a*3 of the valve housing 1912*a*. As the mode switching valve 1912*b* is a known piston type solenoid valve, detailed description thereof has been omitted.

One or a first end of the mode switching connection unit 1913 may be connected to the valve housing 1912*a* of the mode switching valve portion 1912, and another or a second end of the mode switching connection unit 1913 may pass through the casing 110 so as to be connected to the discharge pressure hole 1611*a*, the low-pressure portion 110*a*, and the back pressure switching unit 192, respectively. Accordingly, the mode switching connection portion 1913 may allow refrigerant with its flow direction changed by the mode switching valve portion 1912 to be transferred through the discharge pressure hole 1611*a*, the low-pressure portion 110*a*, and the back pressure switching unit 192.

More specifically, the mode switching connection portion 1913 may include the first connection pipe 1913*a*, the second connection pipe 1913*b*, and the third connection pipe 1913*c*. All of the first connection pipe 1913*a*, the second connection pipe 1913*b*, and the third connection pipe 1913*c* may pass through the casing 110 to be, for example, welded to the casing 110. Accordingly, each of the connection pipes 1913*a*, 1913*b*, and 1913*c* may be formed of a same material as that of the casing 110. However, each of the connection pipes 1913*a*, 1913*b*, and 1913*c* may also be formed of a material different from that of the casing 110, and welded to the casing 110 using an intermediate member (not shown).

However, as the first ends of the first connection pipe 1913*a*, the second connection pipe 1913*b*, and the third connection pipe 1913*c* are respectively fixed to the casing while the second ends thereof are respectively connected to the discharge pressure hole 1611*a*, the low-pressure portion 110*a*, and the back pressure switching unit 192, the second ends of the first connection pipe 1913*a*, the second connection pipe 1913*b*, and the third connection pipe 1913*c* each may be configured as a loop pipe made of a flexible material in view of vibration damping.

For example, the third connection pipe 1913*c* may include a metal connection pipe 1913*c*1 inserted into the back pressure switching valve accommodating portion 1921, which will be described hereinafter, and a flexible connection pipe (or loop pipe) 1913*c*2 inserted into an end portion of the metal connection pipe 1913*c*1 and exposed outwardly of the back pressure switching valve accommodating portion 1921. The metal connection pipe 1913*c*1 may be fixed to the back pressure plate 161 by a U-shaped fixing pin (no reference numeral) to be inserted into a pin hole 1614 provided in the back pressure plate 161. The loop pipe 1913*c*2 may be bent while being press-fitted into the metal connection pipe 1913*c*1, and another or a second end of the loop pipe 1913*c*2 may be fixed to the casing 110.

Next, the back pressure switching unit will be described.

The back pressure switching unit 192 according to this embodiment is a valve configured to mutually switch the first back pressure passage (or first intermediate pressure hole) and the second back pressure passage (or second intermediate pressure hole) that communicate between the compression chamber V and the back pressure chamber S, and may be installed between the compression chamber V and the back pressure chamber S. The back pressure switching unit 192 may be installed at the non-orbiting end plate 151 of the non-orbiting scroll 150, or may be installed at the back pressure plate 161 of the back pressure chamber assembly 160. In this embodiment, an example in which the back pressure switching unit 192 is installed at the back pressure plate 161 of the back pressure chamber assembly 160, more specifically, at the fixed plate portion 1611 where manufacturing of the back pressure switching unit 192 is relatively easy will be described.

Referring to FIGS. 5 to 7, the back pressure switching unit 192 according to this embodiment may include the back pressure switching valve accommodating portion 1921 and the back pressure switching valve 1922. The back pressure switching valve accommodating portion 1921 may be formed as a straight groove which is recessed by a predetermined length in the lateral direction from an outer circumferential surface of the back pressure plate 161 from the outer circumferential surface of the fixed plate portion 1611 toward the center. The back pressure switching valve accommodating portion 1921 according to this embodiment may not be formed in the radial direction toward the center, but may be formed to be twisted by a predetermined angle with respect to the direction toward the center. Accordingly, even if the back pressure switching valve accommodating portion 1921 is formed longer than a width of the fixed plate portion 1611, the back pressure switching valve accommodating portion 1921 may not protrude through an inner circumferential surface of the fixed plate portion 1611 in consideration of a length of the back pressure switching valve 1922, and an insertion depth of the third connection pipe 1913*c*.

One or a first end of the back pressure switching valve accommodating portion 1921 may be opened at the outer circumferential surface of the fixed plate portion 1611 of the back pressure plate 161, and another or a second end of the back pressure switching valve accommodating portion 1921 may be closed inside of the fixed plate portion 1611.

A first accommodating end 1921*a* forming the first end of the open back pressure switching valve accommodating portion 1921 may be provided with the third connection pipe 1913*c* that extends from the mode switching unit 191 to be inserted therein, and a second accommodating end 1921*b* forming the second end of the closed back pressure switching valve accommodating portion 1921 may be provided with a communication hole 1921*c* that communicates with the back pressure chamber S. Accordingly, the first end of the back pressure switching valve accommodating portion 1921 may be connected to the mode switching unit 191, and refrigerant at the discharge pressure (or high pressure) or at the suction pressure (or low pressure) may be provided toward the first accommodating end 1921*a*, which is the first end of the back pressure switching valve accommodating portion 1921, by the mode switching unit 191. The second end of the back pressure switching valve accommodating portion 1921 may communicate with the back pressure chamber S through the communication hole 1921*c*, and refrigerant at the intermediate pressure filled in the back pressure chamber S may be provided toward the second accommodating end 1921*b*, which is the second end of the back pressure switching valve accommodating portion 1921.

Then, according to a pressure difference between the refrigerant provided toward the first accommodating end 1921*a* and the refrigerant provided toward the second accommodating end 1921*b* of the back pressure switching valve accommodating portion 1921, the back pressure switching valve 1922 discussed hereinafter may move between opposite ends of the back pressure switching valve accommodating portion 1921. Then, the first back pressure passage and the second back pressure passage may be alternately opened and closed to change the pressure in the back pressure chamber S. The first back pressure passage may be defined as a back pressure passage through which the first intermediate pressure chamber Vm1 and the back pressure chamber S communicate, and the second back pressure passage may be defined as a back pressure passage through which the second intermediate pressure chamber Vm2 and the back pressure chamber S communicate.

Between the opposite ends of the back pressure switching valve accommodating portion 1921, namely, between the third connection pipe 1913*c* and the communication hole 1921*c*, the back pressure chamber side first back pressure hole 1611*b*1 forming the first back pressure passage and the back pressure chamber side second back pressure hole 1611*b*2 forming the second back pressure passage may respectively communicate therewith as described above. More specifically, one or a first end of the back pressure chamber side first back pressure hole 1611*b*1 and one or a first end of the back pressure chamber side second back pressure hole 1611*b*2 may respectively communicate with a lower portion of the back pressure switching valve accommodating portion 1921, and may be spaced apart from each other by a predetermined distance in a lengthwise direction of the back pressure switching valve accommodating portion 1921. Another or a second end of the back pressure chamber side first back pressure hole 1611*b*1 may communicate with the first intermediate pressure chamber Vm1 of the first compression chamber V1 or the second compression chamber V2, and another or a second end of the back pressure chamber side second back pressure hole 1611*b*2 may communicate with the second intermediate pressure chamber Vm2 of the first compression chamber V1 or the second compression chamber V2.

In addition, at an upper portion of the back pressure switching valve accommodating portion 1921 between the opposite ends of the back pressure switching valve accommodating portion 1921, more specifically, between the back pressure chamber side first back pressure hole 1611*b*1 and the back pressure chamber side second back pressure hole 1611*b*2, one or a first end of the back pressure chamber side common back pressure hole 1611*c* forming the common intermediate pressure hole may communicate therewith. Another or a second end of the back pressure chamber side common back pressure hole (or common intermediate pressure hole) 1611*c* may be formed through a bottom surface of the fixed plate portion 1611 forming the back pressure chamber S. Accordingly, depending on a position of the back pressure switching valve 1922, in other words, depending on the operation mode of the compressor, the back pressure chamber side first back pressure hole 1611*b*1 may communicate with the back pressure chamber side common back pressure hole 1611*c* or the back pressure chamber side second back pressure hole 1611*b*2 may communicate with the back pressure chamber side common back pressure hole 1611*c*.

At a periphery of the first end of the back pressure switching valve accommodating portion 1921, more specifically, between the third connection pipe 1913*c* and the back pressure switching valve 1922 facing the third connection pipe 1913*c*, there may be formed the mode switching hole 1611*d* described above. This will be described hereinafter together with the capacity variable valve.

The back pressure switching valve 1922 may be formed in a rod shape having a predetermined length between a first valve end 1922*a* and a second valve end 1922*b*, which are opposite ends of the back pressure switching valve 1922, and may be inserted in the back pressure switching valve accommodating portion 1921 to be movable between the opposite ends of the back pressure switching valve accommodating portion 1921 in the lengthwise direction. The back pressure switching valve 1922 may be formed with a first communication groove 1922*c*1 and a second communication groove 1922*c*2 in the lengthwise direction, and a communication groove sealing member 1922*d*, such as an O-ring, may be inserted in a portion at one end of the first communication groove 1922*c*1, in a portion between the first communication groove 1922*c*1 and the second communication groove 1922*c*2, and in a portion at one end of the second communication groove 1922*c*2, respectively. Accordingly, between an inner space of the back pressure switching valve accommodating portion 1921 at the communication hole 1921*c* side and the first communication groove 1922*c*1, between the first communication groove 1922*c*1 and the second communication groove 1922*c*2, and between the second communication groove 1922*c*2 and an inner space of the back pressure switching valve accommodating portion 1921 at the third connection pipe 1913*c* side may be sealed.

Next, the capacity variable unit will be described.

The capacity variable unit 193 according to this embodiment is a valve that switches the operation mode of the compressor by opening and closing the capacity variable passage (or third intermediate pressure hole) while being operated by the mode switching unit 191. The capacity variable unit 193 may be installed between the compression chamber V and the low-pressure portion 110*a* of the casing 110. The capacity variable unit 193 may be installed at the non-orbiting end plate 151 of the non-orbiting scroll 150, or may be installed at the back pressure plate 161 of the back pressure chamber assembly 160. In this embodiment, an example in which the capacity variable unit 193 is installed at the back pressure plate 161 of the back pressure chamber assembly 160, more specifically, at the fixed plate portion 1611 where manufacturing of the capacity variable unit 193 is relatively easy will be described.

The capacity variable unit 193 may also be installed inside of the back pressure chamber assembly 160 or outside of the back pressure chamber assembly 160. As the capacity variable passage including the capacity variable hole generates a kind of dead volume, minimizing a length of the capacity variable passage by installing the capacity variable unit 193 closest to an outlet end of the capacity variable passage may be advantageous in terms of reducing the dead volume. However, in this case, as the capacity variable unit 193 should be installed inside of the back pressure chamber assembly 160, a shape of the capacity variable unit 193 may be limited by that amount and installation of the capacity variable unit 193 may be difficult. Accordingly, in this embodiment, an example in which the capacity variable unit 193 is installed on an outer circumferential surface of the back pressure chamber assembly 160 will be described. This may also be applied to a case in which the capacity variable unit 193 is installed at the non-orbiting scroll 150.

In addition, one or a plurality of the capacity variable unit 193 may be provided. More specifically, as the capacity variable passage is formed to communicate with each of the first compression chamber V1 and the second compression chamber V2 as described above, a plurality of the capacity variable unit 193 may be provided to correspond to each of the capacity variable passages one-to-one or may be provided as one piece to open and close capacity variable passages which are integrated into one. In this embodiment, an example in which a plurality of capacity variable units 193 is employed will be described. As the plurality of capacity variable units 193 is formed to be symmetrical to each other, hereinafter, a capacity variable unit 193 at one side will be described as a representative example.

Referring to FIGS. 6 and 7, the capacity variable unit 193 may include a valve guide 1931 and a capacity variable valve 1932. The valve guide 1931 may be fixedly installed on the valve fixing surface 1612 provided on the outer circumferential surface of the back pressure plate 161. As described above, the valve fixing surface 1612 may be formed with an outlet end of the first capacity variable passage 1611*f*1 that communicates with the first capacity variable hole 1513*a* of the non-orbiting scroll 150, and the outlet end of the first capacity variable passage 1611*f*1 may be opened and closed by the capacity variable valve 1932 to be described hereinafter. The first capacity variable passage 1611*f*1 may be formed in a shape of a hole that penetrates a center of the valve fixing surface 1612 or in a shape of a groove recessed in a bottom surface of the back pressure plate 161. In this embodiment, an example in which the first capacity variable passage 1611*f*1 is formed as a shape of a hole will be described.

The valve guide 1931 may have a valve accommodating space 1931*a*, formed in the radial direction, into which the capacity variable valve 1932 may be slidably inserted. A size of an inner diameter of the valve accommodating space 1931*a* may be constant in the radial direction, and in some cases, may gradually decrease in a direction toward the valve fixing surface 1612.

At a front side of the valve accommodating space 1931*a* (hereinafter, a side facing the valve fixing surface will be defined as a front), a discharge passage 1931*b* that is opened and closed by the capacity variable valve 1932 may be formed. The discharge passage 1931*b* may be formed in a shape of a recessed groove at a front surface of the valve guide 1931 or in a shape of a hole penetrating from an inner circumferential surface of the valve accommodating space 1931*a* to an outer circumferential surface of the valve guide 1931. In this embodiment, an example in which the discharge passage 1931*b* is formed as a groove will be described.

One or a first end of the discharge passage 1931*b* may be formed at a position where the first end of the discharge passage 1931*b* is blocked from the first capacity variable passage 1611*f*1 when the capacity variable valve 1932 is moved to the first position, which is a closed position, but communicates with the first capacity variable passage 1611*f*1 when the capacity variable valve 1932 is moved to the second position, which is an open position. Another or a second end of the discharge passage 1931*b* may be formed to communicate with the low-pressure portion 110*a* of the casing 110. Accordingly, in a state in which the capacity variable valve 1932 is moved to the first position, the compression chamber V (to be precise, the third intermediate pressure chamber) may be blocked from the low-pressure portion 110*a* of the casing 110, while in a state in which the capacity variable valve 1932 is moved to the second position, the compression chamber V (to be precise, the third intermediate pressure chamber) may communicate with the low-pressure portion 110*a* of the casing 110 so that refrigerant in the compression chamber V may be bypassed to the low-pressure portion 110*a* of the casing 110 before moving further toward the discharge pressure chamber Vd.

At a rear side (or a side opposite to the valve fixing surface) of the valve accommodating space 1931*a*, a differential pressure space 1931*c* configured to provide operating pressure to a rear surface of the capacity variable valve 1932 that is inserted into the valve accommodating space 1931*a* may be extended therefrom.

An inner diameter of the differential pressure space 1931*c* may be smaller than an inner diameter of the valve accommodating space 1931*a*, and a valve stopping surface 1931*d* may be formed to be stepped between the valve accommodating space 1931*a* and the differential pressure space 1931*c*. Accordingly, when the capacity variable valve 1932 is moved to the second position which is the open position, an extent of opening of the capacity variable valve 1932 may be limited by being caught on the valve stopping surface 1931*d*.

At the differential pressure space 1931*c*, there may be formed the injection hole 1931*e* through which an operating pressure is provided. The injection hole 1931*e* may be formed to penetrate between an inner circumferential surface of the differential pressure space 1931*c* and an outer surface of the valve guide 1931, or may be formed to penetrate through an inner portion of the valve guide 1931 in the radial direction. In this embodiment, an example in which the injection hole 1931*e* is radially formed through the inner portion of the valve guide 1931 will be described.

The injection hole 1931*e* may penetrate between the front surface of the valve guide 1931 and the differential pressure space 1931*c*. More specifically, one or a first end of the injection hole 1931*e* may be formed through the front surface of the valve guide 1931, and another or a second end of the injection hole 1931*e* may be formed through a circumferential surface of the differential pressure space 1931*c*. The back pressure plate 161 may have the mode switching passage 1611*e* that communicates between the mode switching hole 1611*d* and the injection hole 1931*e* as described above.

The mode switching passage 1611*e* may be formed in a shape of a hole passing through the back pressure plate 161, or formed in a shape of a groove recessed from one surface of the back pressure plate 161, that is, a lower surface of the back pressure plate 161 facing the upper surface of the non-orbiting scroll 150, or may also be formed such that grooves and holes are sequentially arranged. In this embodiment, an example in which the mode switching passage 1611*e* is formed such that grooves and holes are sequentially arranged will be described.

In addition, the mode switching passage 1611*e* may be formed to be separated into a plurality of mode switching passages 1611*e* at the mode switching hole 1611*d* so as to communicate with each of the valve fixing surfaces 1612 at opposite sides. However, as in this embodiment, the mode switching passage 1611*e* may also be formed to extend from the mode switching hole 1611*d*, then be separated in the middle so as to communicate with each of the valve fixing surfaces 1612 at opposite sides. In this embodiment, an example in which one mode switching passage 1611*e* extends from the mode switching hole 1611*d*, then is separated in the middle will be described.

The mode switching passage 1611*e* may include a passage groove portion 1611*e*1 and a passage hole portion 1611*e*2. The passage groove portion 1611*e*1 may be recessed from the lower surface of the back pressure plate 161 and formed in an arc shape to surround the intermediate discharge port 1618, and the passage hole portion 1611*e*2 may be bent or inclined from the lower surface of the back pressure plate 161 toward the valve fixing surface 1612 provided on the outer circumferential surface.

More specifically, one or a first end of the passage groove portion 1611*e*1 may communicate with an outlet side end portion of the mode switching hole 1611*d*, and one or a first end of the passage hole portion 1611*e*2 may communicate with a middle and another or a second end of the passage groove portion 1611*e*1. Accordingly, refrigerant at the discharge pressure or at the suction pressure (or an operating pressure) provided through the mode switching hole 1611*d* may be injected into the differential pressure spaces 1931*c* at opposite sides of the capacity variable units 193 through the passage groove portion 1611*e*1 and the passage hole portion 1611*e*2 forming the mode switching passage 1611*e*, and the capacity variable valve 1932 may move forward or backward depending on the operating pressure of the refrigerant injected into the differential pressure space 1931*d* to open or close the first capacity variable passage 1611*f*1 to thereby switch the operation mode of the compressor.

The capacity variable valve 1932 may be a piston valve. More specifically, the capacity variable valve 1932 may be formed in a circular cross-sectional shape having an outer diameter substantially the same as an inner diameter of the valve accommodating space 1931*a* so as to be slidable inside of the valve accommodating space 1931*a*.

As the capacity variable valve 1932 moves according to a difference between a pressure in the differential pressure space 1931*c* and a pressure in the first capacity variable passage 1611*f*1, an opening and closing surface 1932*a* and a back pressure surface 1932*b* of the capacity variable valve 1932 each may collide with an outer side surface (or valve fixing surface) of the back pressure plate 161 or with the valve stopping surface 1931*d* of the valve guide 1931. For this reason, the capacity variable valve 1932 may be made of a material capable of minimizing noise during collision and to sliding smoothly, while having rigidity sufficient not to be damaged by the collision, for example, a material such as engineering plastic.

The capacity variable valve 1932 may be configured to be moved only by the pressure difference between the opening and closing surface 1932*a* and the back pressure surface 1932*b*, but in some cases, the capacity variable valve 1932 may further be provided with a pressure spring (not shown), such as a compression coil spring, on the back pressure surface 1932*b*. Accordingly, when the pressure applied to the back pressure surface 1932*b* is low because the intermediate pressure does not reach a sufficient pressure, such as when the compressor is started, the pressure spring may push the capacity variable valve 1932 forward to prevent the capacity variable valve 1932 from shaking due to the small pressure difference between opposite sides of the capacity variable valve 1932.

In addition, instead of the pressure spring, a sealing member (not shown), such as an O-ring, may be inserted into a sliding surface of the valve guide 1931 in contact with an outer diameter surface of the capacity variable valve 1932. This may prevent leakage due to a differential pressure between the valve accommodating space 1931*a* and the first capacity variable passage 1611*f*1 and shaking due to the pressure difference at the capacity variable valve 1932.

An operation according to the operation mode in the scroll compressor described above is as follows. First, the power operation mode will be described.

Figure 8:
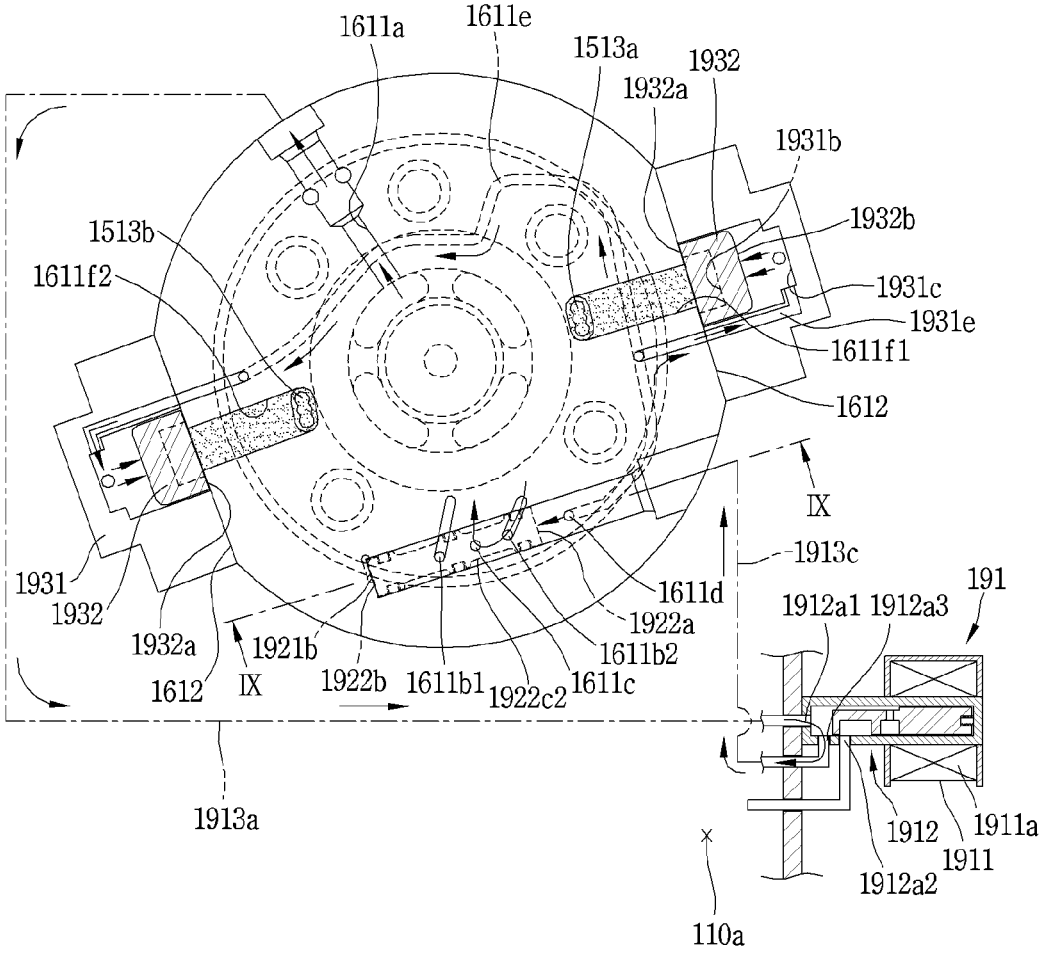
FIG. 8 is a schematic view illustrating an operation of a mode switching unit, a back pressure switching unit, and a capacity variable unit during a power operation mode in the scroll compressor according to an embodiment.
Figure 9:
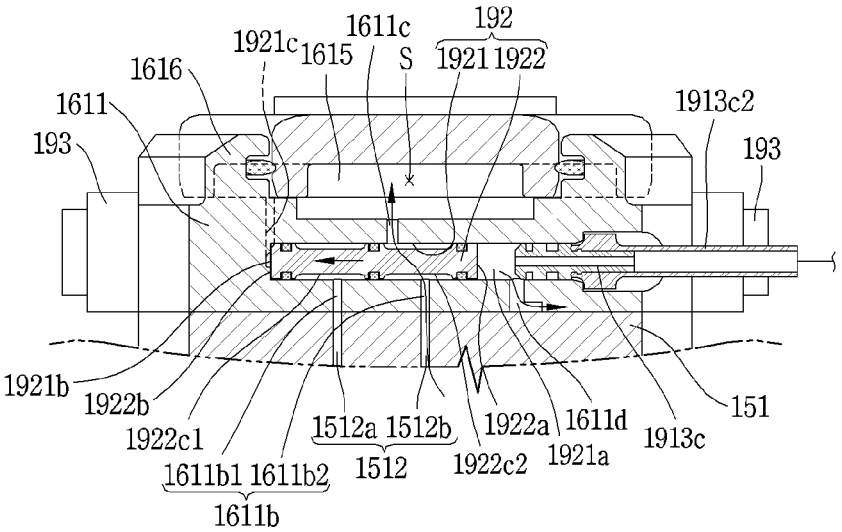
FIG. 9 is a cross-sectional view, taken along line "IX-IX" of FIG. 8.

FIG. 8 is a schematic view illustrating an operation of a mode switching unit, a back pressure switching unit, and a capacity variable unit during a power operation mode in the scroll compressor according to an embodiment. FIG. 9 is a cross-sectional view, taken along line "IX-IX" of FIG. 8.

Referring back to FIG. 3, power is applied to the mode switching unit 191 and the mode switching unit 191 may be switched to the power operation mode. Then, each of the back pressure switching unit 192 and the capacity variable unit 193 connected to the mode switching unit 191 may be sequentially switched to the power operation mode. At this time, refrigerant in the second intermediate pressure chamber Vm2 at a relatively lower pressure than refrigerant in the first intermediate pressure chamber Vm1 may be moved to the back pressure chamber S by the back pressure switching unit 192, and the capacity variable unit 193 may close the first capacity variable passage 1611*f*1 to perform a full load operation in which the entire compression chamber is utilized.

More specifically, referring to FIGS. 8 and 9, when power is applied to the valve coil 1911*a* of the valve power supply unit 1911 forming the mode switching unit 191, the valve actuator 1911*b* and the mode switching valve 1912*b* coupled to the valve actuator 1911*b* may be moved to the first position (or power operation mode). Then, the first connection pipe 1913*a* and the third connection pipe 1913*c* may be connected to each other by the mode switching valve 1912*b*. Then, through the discharge pressure hole 1611*a*, high-pressure refrigerant may move to the third connection pipe 1913*c* through the first connection pipe 1913*a*, and the high-pressure refrigerant may flow toward the first accommodating end 1921*a* of the back pressure switching valve accommodating portion 1921 forming a portion of the back pressure switching unit 192.

The back pressure switching valve 1922 may be pushed toward the second accommodating end (or the communication hole) 1921*b* of the back pressure switching valve accommodating portion 1921 by the high-pressure refrigerant, and the back pressure chamber side second back pressure hole 1611*b*2 may communicate with the back pressure chamber side common back pressure hole 1611*c* through the second communication groove 1922*c*2 of the back pressure switching valve 1922. Then, a portion of the refrigerant in the second intermediate pressure chamber Vm2 may move to the back pressure chamber S through the back pressure chamber side second back pressure hole 1611*b*2 and the back pressure chamber side common back pressure hole 1611*c* to allow the back pressure chamber S to have the second intermediate pressure relatively lower the first intermediate pressure. This may lower an adhesion degree of the non-orbiting scroll 150 to the orbiting scroll 140 in the power operation mode, thereby preventing excessive frictional loss.

The first valve end (or a third communication pipe side end portion) 1922*a* of the back pressure switching valve 1922 may be supported by the discharge pressure provided through the third connection pipe 1913*c*, and the second valve end (or a communication hole side end portion) 1922*b*, which is an opposite side of the second valve end, may be supported by the second intermediate pressure, which is the back pressure of the back pressure chamber S, through the communication hole 1921*c* that communicates with the back pressure chamber S. Accordingly, the back pressure switching valve 1922 may be pushed toward the communication hole 1921*c*, and the communication hole 1921*c* may then be blocked by the second valve end 1922*b*. This may maintain a state in which the back pressure chamber side second back pressure hole 1611*b*2 communicates with the back pressure chamber side common back pressure hole 1611*c*.

In addition, as the back pressure switching valve 1922 is pushed toward the first valve end 1922*a*, the mode switching hole 1611*d* may be opened to thereby allow the back pressure switching valve accommodating portion 1921 and the mode switching hole 1611*d* to communicate with each other. Then, a portion of the high-pressure refrigerant flowing toward the first accommodating end 1921*a* of the back pressure switching valve accommodating portion 1921 through the third connection pipe 1913*c* may flow into the mode switching hole 1611*d*, and the refrigerant may then move to the injection hole 1931*e* through the mode switching passage 1611*e*.

The high-pressure refrigerant may move into the differential pressure space 1931*c* through the injection hole 1931*e*, and the high-pressure refrigerant moving into the differential pressure space 1931*c* may push the back pressure surface 1932*b* of the capacity variable valve 1932 to allow the opening and closing surface 1932*a* of the capacity variable valve 1932 to move to the front side, namely, to the first position that blocks each of the capacity variable passages 1611*f*1 and 1611*f*2. The capacity variable passages 1611*f*1 and 1611*f*2 may be blocked by the opening and closing surface 1932*a* of the capacity variable valve 1932, and consequently the capacity variable holes 1513*a* and 1513*b* may be blocked. The refrigerant may be suctioned into the suction pressure chamber Vs of each of the compression chambers V1 and V2, and an entire amount of the refrigerant (excluding an amount bypassed for preventing over compression) may be compressed while moving to the discharge pressure chamber Vd without being bypassed through the capacity variable holes 1513*a* and 1513*b*, then the compressed refrigerant may be discharged to the high-pressure portion 110*b* of the casing 110 through the discharge port 1511 and the intermediate discharge port 1618.

Hereinafter, the saving operation mode will be described.

Figure 10:
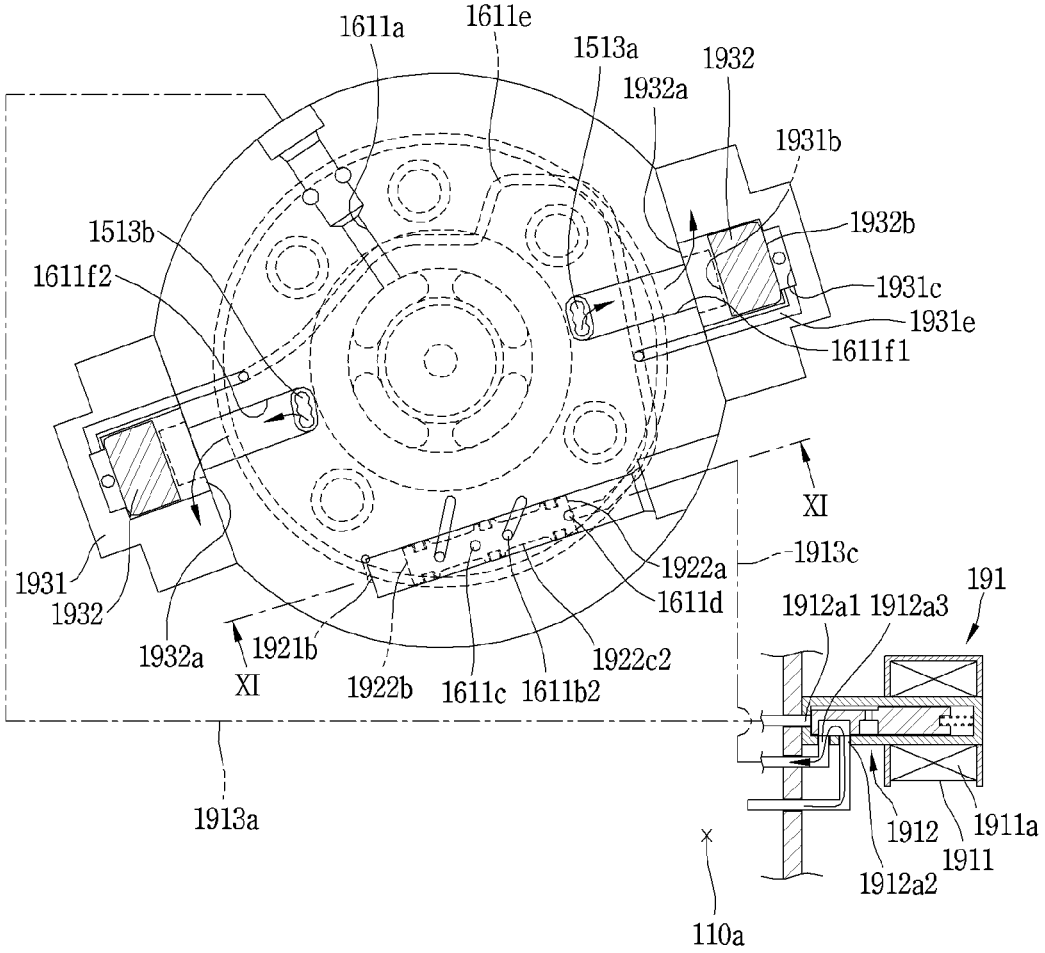
FIG. 10 is a schematic view illustrating an operation of a mode switching unit, a back pressure switching unit, and a capacity variable unit during a saving operation mode in the scroll compressor according to an embodiment.
Figure 11:
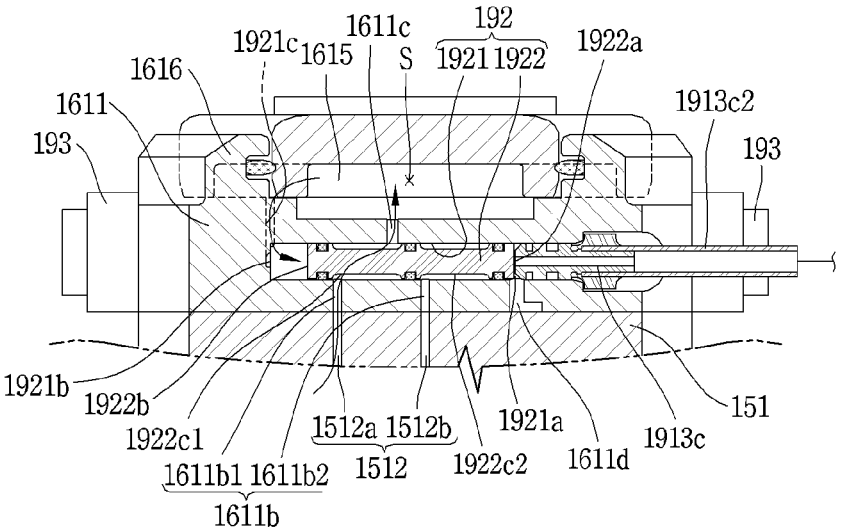
FIG. 11 is a cross-sectional view, taken along line "XI-XI" of FIG. 10.

FIG. 10 is a schematic view illustrating an operation of a mode switching unit, a back pressure switching unit, and a capacity variable unit during a saving operation mode in the scroll compressor according to an embodiment. FIG. 11 is a cross-sectional view, taken along line "XI-XI" of FIG. 8.

Referring back to FIG. 3, when power is off at the mode switching unit 191, the mode switching unit 191 may be switched to the saving operation mode. Then, the back pressure switching unit 192 and the capacity variable unit 193 connected to the mode switching unit 191 may be sequentially switched to the saving operation mode. At this time, refrigerant in the first intermediate pressure chamber Vm1 at a relatively higher pressure than refrigerant in the second intermediate pressure chamber Vm2 may be moved to the back pressure chamber S by the back pressure switching valve 1922, and the capacity variable unit 193 may open the capacity variable passages 1611*f*1 and 1611*f*2 to perform the partial load operation in which only a portion of the compression chamber V is utilized.

More specifically, referring to FIGS. 10 and 11, when power is off at the valve coil 1911*a* of the valve power supply unit 1911 forming the mode switching unit 191, the valve actuator 1911*b* may return to the second position (or saving operation mode) by the valve return spring 1911*c*. The second connection pipe 1913*b* and the third connection pipe 1913*c* may be connected to each other by the mode switching valve 1912*b*. Low-pressure refrigerant filled in the low-pressure portion 110*a* of the casing 110 may move to the third connection pipe 1913*c* through the second connection pipe 1913*b*, and the low-pressure refrigerant may be introduced into the back pressure switching valve accommodating portion 1921 forming a portion of the back pressure switching unit 192.

Then, the back pressure switching valve 1922 may be pushed toward the second accommodating end (or the third communication pipe) 1921*b* of the back pressure switching valve accommodating portion 1921, and the back pressure chamber side first back pressure hole 1611*b*1 may communicate with the back pressure chamber side common back pressure hole 1611*c* through the first communication groove 1922*c*1 of the back pressure switching valve 1922. A portion of the refrigerant in the first intermediate pressure chamber Vm1 may move to the back pressure chamber S through the back pressure chamber side first back pressure hole 1611*b*1 and the back pressure chamber side common back pressure hole 1611*c* to allow the back pressure chamber S to have the first intermediate pressure relatively higher than the second intermediate pressure. This may allow the non-orbiting scroll 150 to be tightly brought into contact with the orbiting scroll 140 in the saving operation mode to thereby suppress leakage.

The first valve end (or the third communication pipe side end portion) 1922*a* of the back pressure switching valve 1922 may be supported by the suction pressure provided through the third connection pipe 1913*c*, and the second valve end 1922*b*, which is the opposite side of the second valve end in the back pressure switching valve 1922, may be supported by the first intermediate pressure equal to the back pressure of the back pressure chamber S. Accordingly, the back pressure switching valve 1922 may be pushed toward the third connection pipe 1913*c* by the pressure difference between the opposite ends, and thus, a state in which the back pressure chamber side first back pressure hole 1611*b*1 communicates with the back pressure chamber side common back pressure hole 1611*c* may be maintained.

In addition, as the back pressure switching valve 1922 is pushed toward the first accommodating end 1921*a* of the back pressure switching valve accommodating portion 1921 to allow the first valve end 1922*a* of the back pressure switching valve 1922 to be tightly brought into contact with the third connection pipe 1913*c*, the mode switching hole 1611*d* may be blocked by the back pressure switching valve 1922 to thereby block the mode switching passage 1611*e*. This may block communication between the back pressure switching valve accommodating portion 1921 and the differential pressure space 1931*c*, thereby changing the differential pressure space 1931*c* to be a low pressure state. The high-pressure refrigerant remaining in the differential pressure space 1931*c* may leak to the low-pressure portion 110*a* of the casing 110 through a leakage hole (no reference numeral) that communicates with the differential pressure space 1931*c*.

The back pressure surface 1932*b* of the capacity variable valve 1932 may be exposed to the low pressure state, while the opening and closing surface 1932*a* of the capacity variable valve 1932 is exposed to a third intermediate pressure state through the capacity variable passages 1611*f*1 and 1611*f*2. The capacity variable valve 1932 may be moved to a rear side, namely, to the second position that opens the capacity variable passages 1611*f*1 and 1611*f*2.

As the refrigerant in the capacity variable passages 1611*f*1 and 1611*f*2 leaks to the low-pressure portion 110*a* of the casing 110 through the discharge passage 1931*b*, refrigerant suctioned into the suction pressure chamber Vs of each of the compression chambers V1 and V2 may proceed with a substantial compression cycle from a point when the refrigerant passes through the back pressure chamber side common back pressure hole 1611*c*. Accordingly, only a portion of the suctioned refrigerant may be compressed while moving to the discharge pressure chamber Vd, then discharged to the high-pressure portion 110*b* of the casing 110 through the discharge port 1511 and the intermediate discharge port 1618.

Hereinafter, a description will be given of another embodiment of the capacity variable unit. In the above-described embodiment, a plurality of the capacity variable unit is provided, but in some cases, the capacity variable unit may be provided as one piece.

Figure 12:
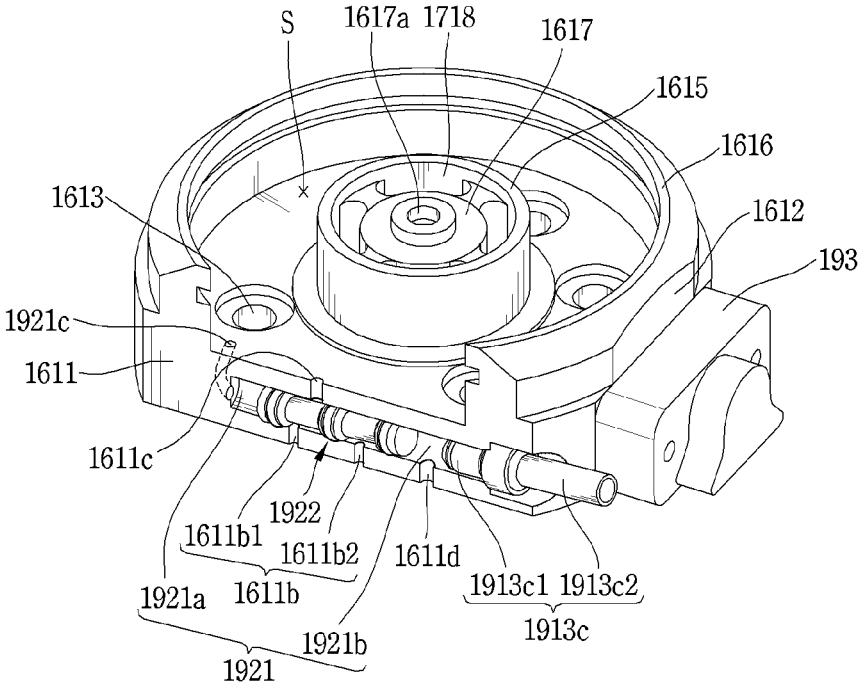
FIG. 12 is a perspective view and FIG. 13 is a planar view of a capacity variable unit in a capacity-variable scroll compressor according to another embodiment.
Figure 13:
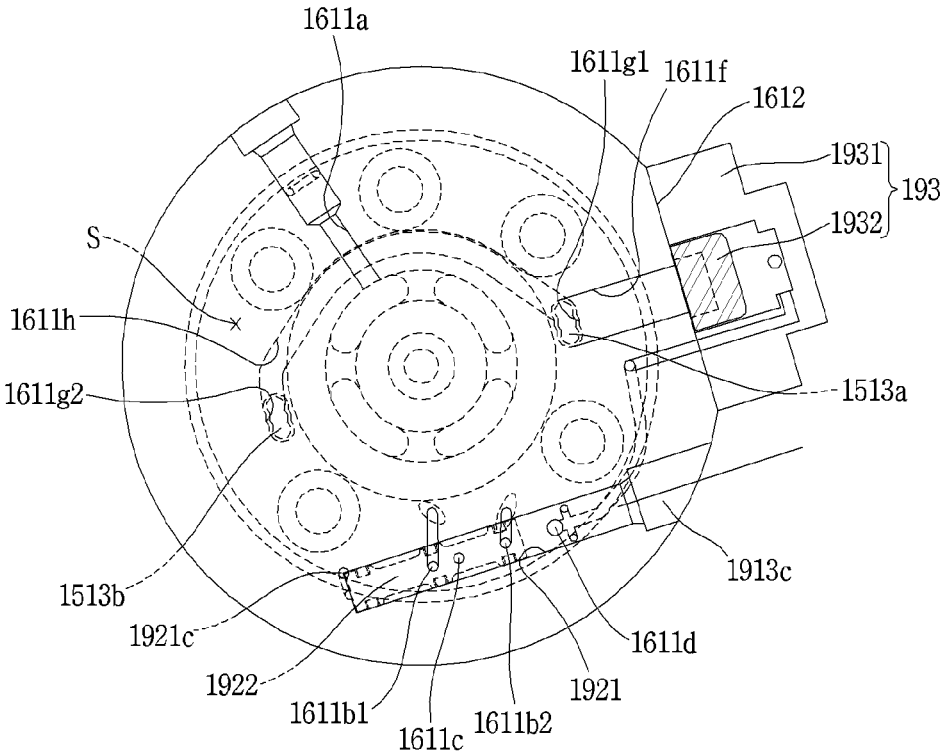

FIG. 12 is a perspective view and FIG. 13 is a planar view of a capacity variable unit in a capacity-variable scroll compressor according to another embodiment. A basic configuration of mode switching unit 191, back pressure switching unit 192, and a scroll compressor including non-orbiting scroll 150 according to this embodiment may be formed in a same manner as in the embodiment of FIG. 5 described above. Therefore, repetitive description thereof has been omitted.

In addition, as back pressure plate 161 and capacity variable unit 193 installed on back pressure plate 161 according to this embodiment are generally similar to the embodiment of FIG. 5, repetitive description thereof has been omitted. In the following description, different components will be described.

Referring to FIGS. 12 and 13, fixed plate portion 1611 of the back pressure plate 161 according to this embodiment may be generally formed in a disk shape, and may have a single valve fixing surface 1612 at one side of an outer circumferential surface thereof. The valve fixing surface 1612 may have an outlet (no reference numeral) of one capacity variable passage 1611*f* that communicates with first capacity variable hole 1513*a* and second capacity variable hole 1513*b* of the non-orbiting scroll 150 formed therethrough, and one or a first side of the capacity variable passage 1611*f* may have an outlet (no reference numeral) of mode switching passage 1611*e* communicating with mode switching hole 1611*d* formed therethrough.

More specifically, a lower surface of the back pressure plate 161 may be formed with first capacity variable accommodation groove 1611*g*1 that communicates with first capacity variable hole 1513*a*, and second capacity variable accommodation groove 1611*g*2 that communicates with second capacity variable hole 1513*b*. The first capacity variable accommodation groove 1611*g*1 and the second capacity variable accommodation groove 1611*g*2 may be connected by a single capacity variable communication groove 1611*h*, and there may be provided capacity variable passage 1611*f* extending from a middle of the capacity variable communication groove 1611*h* or from either side of capacity variable communication groove 1611*h* to the valve fixing surface 1612.

The capacity variable passage 1611*f* may be bent or inclined as in the above-described embodiment so that one or a first end thereof passes through a lower surface of the back pressure plate 161 and another or a second end thereof passes through an outer circumferential surface of the back pressure plate 161. The first capacity variable accommodation groove 1611*g*1 and the second capacity variable accommodation groove 1611*g*2 may have a phase difference of approximately 180° with respect to each other to correspond to the first capacity variable hole 1513*a* and the second capacity variable hole 1513*b*, respectively.

The capacity variable communication groove 1611*h* may be formed in a substantially semicircular shape, so that the first capacity variable accommodation groove 1611*g*1 and the second capacity variable accommodation groove 1611*g*2 may be connected to opposite ends of the capacity variable communication groove 1611*h*, respectively. Accordingly, the first capacity variable hole 1513*a* and the second capacity variable hole 1513*b* may be connected to the capacity variable communication groove 1611*h* through the first capacity variable accommodation groove 1611*g*1 and the second capacity variable accommodation groove 1611*g*2.

An operation in the mode switching operation in the scroll compressor including the capacity variable unit according to this embodiment is almost the same as that of the above-described embodiment. Therefore, repetitive description thereof has been omitted.

However, in this embodiment, refrigerant at a third intermediate pressure discharged through the capacity variable holes 1513*a* and 1513*b* may move toward one of the capacity variable accommodation grooves (the first capacity variable accommodation groove in the drawing) 1611*g*1 through the capacity variable communication groove 1611*h*, and the refrigerant may then move toward an opening and closing surface 1932*a* of a capacity variable valve 1932 of the capacity variable unit 193 through the capacity variable passage 1611*f* extended from the corresponding capacity variable groove 1611*g*1.

In a case of the power operation mode, a discharge pressure may be injected into differential pressure space 1931*c* of the capacity variable unit 193 as in the embodiment of FIG. 5 above, and thus, a pressure applied to the back pressure surface 1932*b* of the capacity variable valve 1932 (or discharge pressure) may be higher than a pressure applied to the opening and closing surface 1932*a* (or third intermediate pressure). Then, the capacity variable valve 1932 of the capacity variable unit 193 may maintain a first position, which is a closed position, to thereby block communication between the capacity variable passage 1611*f* and discharge passage 1931*b*. This may block the refrigerant in third intermediate pressure chamber Vm3 from being bypassed, thereby allowing the compressor to continue the power operation mode.

On the other hand, in a case of the saving operation mode, a suction pressure may be injected into the differential pressure space 1931*c* of the capacity variable unit 193 as in the embodiment of FIG. 5 above, and thus, a pressure applied to the back pressure surface 1932*b* of the capacity variable valve 1932 (or suction pressure) may be lower than a pressure applied to the opening and closing surface 1932*a* (or third intermediate pressure). Then, the capacity variable valve 1932 of the capacity variable unit 193 may be pushed to a second position, which is an open position, thereby allowing the capacity variable passage 1611*f* and the discharge passage 1931*b* to communicate with each other. This may allow the refrigerant in the third intermediate pressure chamber Vm3 to be bypassed through the capacity variable passage 1611*f* and the discharge passage 1931*b*, and thus, the compressor may be switched to the saving operation mode.

In this way, with a single capacity variable unit 193 installed on the back pressure plate 161, the capacity variable passages 1611*f* both may be collectively opened and closed to smoothly switch the operation mode of the compressor. Accordingly, the number of capacity variable units 193 may be reduced to thereby reduce the number of components and assemblers therefor. This may also lower manufacturing costs of the compressor.

Hereinafter, description will be given of another embodiment of the back pressure switching unit. In the above-described embodiment, the back pressure switching unit is formed to be elongated in a direction axially deviated from the center of the back pressure plate 161, but in some cases, the back pressure switching unit 192 may be formed in the radial direction toward the center of the back pressure plate 161.

Figure 14:
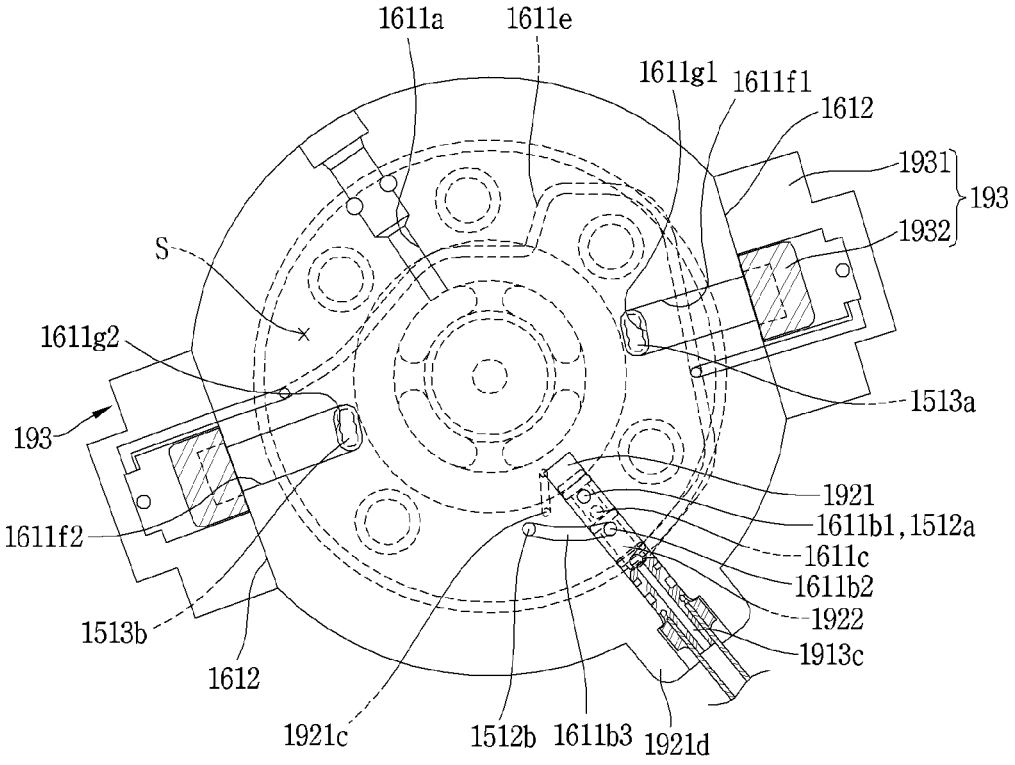
FIG. 14 is a planar view of a back pressure switching unit in a capacity-variable scroll compressor according to another embodiment.

FIG. 14 is a planar view of a back pressure switching unit in a capacity-variable scroll compressor according to another embodiment. A basic configuration of mode switching unit 191, capacity variable unit 193, and scroll compressor including non-orbiting scroll 150 according to this embodiment may be formed in a same manner as in the embodiment of FIGS. 5 and 12 described above. Therefore, repetitive description thereof has been omitted.

In addition, as back pressure plate 161 and back pressure switching unit 192 installed on back pressure plate 161 according to this embodiment are generally similar to the embodiments of FIGS. 5 and 12, repetitive description thereof has been omitted. In the following description, different components will be described.

Referring to FIG. 14, fixed plate portion 1611 of the back pressure plate 161 according to this embodiment may be provided with back pressure switching valve accommodating portion 1921 formed therein. More specifically, the back pressure switching valve accommodating portion 1921 may be formed between back pressure chamber side first back pressure hole 1611*b*1 and back pressure chamber side common back pressure hole 1611*c*, or between back pressure chamber side second back pressure hole 1611*b*2 and the back pressure chamber side common back pressure hole 1611*c*.

In the back pressure switching valve accommodating portion 1921, the back pressure chamber side common back pressure hole 1611*c* may communicate with the back pressure chamber side first back pressure hole 1611*b*1 or with the back pressure chamber side second back pressure hole 1611*b*2, by back pressure switching valve 1922 inserted in the back pressure switching valve accommodating portion 1921 that moves according to the operation mode of the compressor. As the back pressure switching valve accommodating portion 1921 and its connection structure, and back pressure switching valve are the same as those of the above-described embodiments, repetitive description thereof has been omitted.

However, the back pressure switching valve accommodating portion 1921 according to this embodiment may be formed in the radial direction as described above. Accordingly, a length of the back pressure switching valve accommodating portion 1921 may be shorter than a gap between an inner circumferential surface and an outer circumferential surface of the fixed plate portion 1611. In addition, as the back pressure switching valve accommodating portion 1921 according to this embodiment is formed in the radial direction, the back pressure switching valve accommodating portion 1921 may axially overlap at least one of the back pressure chamber side first back pressure hole 1611*b*1 or the back pressure chamber side second back pressure hole 1611*b*2. In this embodiment, an example in which the back pressure switching valve accommodating portion 1921 axially overlaps with the back pressure chamber side first back pressure hole 1611*b*1 will be described.

The back pressure chamber side first back pressure hole 1611*b*1 may be formed in the axial direction to communicate with the back pressure switching valve accommodating portion 1921, and the back pressure chamber side second back pressure hole 1611*b*2 may be formed in the axial direction and further provided with connection groove 1611*b*3 on a lower surface of the back pressure plate 161 (or an upper surface of the non-orbiting scroll) to communicate with the back pressure switching valve accommodating portion 1921. This may reduce the number of connection grooves 1611*b*3 compared to the above-described embodiments.

When the back pressure switching valve accommodating portion 1921 is formed in the radial direction as in this embodiment, an end portion of third connection pipe 1913*c* may be connected to the back pressure switching valve accommodating portion 1921 in a press-fitting manner, but in some cases, the end portion of the third connection pipe 1913*c* may be connected to the back pressure switching valve accommodating portion 1921 with connection protrusion 1921*d* formed on an outer circumferential surface of the back pressure plate 161, as illustrated in FIG. 14.

When the third connection pipe 1913*c* is connected to the back pressure switching valve accommodating portion 1921 in a press-fitting manner, an insertion length of the third connection pipe 1913*c* may be minimized to secure a valve space of the back pressure switching valve accommodating portion 1921. When the third connection pipe 1913*c* is connected to the back pressure switching valve accommodating portion 1921 with the connection protrusion 1921*d* formed on the outer circumferential surface of the back pressure plate 161 as in FIG. 14, a portion of a loop pipe forming a portion of the third connection pipe 1913*c* may be inserted into the connection protrusion 1921 as in the above-described embodiments. Accordingly, a portion of compression chamber side back pressure holes 1512*a* and 1512*b* may be connected to the back pressure switching valve accommodating portion 1921 without the connection groove 1611*b*3, while allowing a metal connection pipe 1913*c*1 to be connected to the back pressure plate 161 with a U-shaped pin (not shown). This may facilitate assembly of the third connection pipe 1913*c* and manufacturing of the back pressure passage.

An operation mode switching operation in the scroll compressor including the back pressure switching unit 192 according to this embodiment is almost the same as that of the above-described embodiment. Therefore, detailed description thereof has been omitted.

In the above-described embodiments, the back pressure switching unit, the capacity variable unit, and the configuration connected to these units are formed on the lower surface of the back pressure plate or inside of the back pressure plate, but in some cases, these units may be formed on the upper surface of the non-orbiting scroll or inside of the non-orbiting scroll. The shape and specification of these components, and the effect thereof, may be formed in the same manner as in the above-described embodiment. Therefore, detailed description thereof has been omitted. However, as in this embodiment, when a component for varying the capacity, in particular, the capacity variable passage is formed at a rear surface of the non-orbiting end plate, a length of the variable capacity passage may be reduced, thereby reducing a dead volume by that amount.

Embodiments disclosed herein provide a scroll compressor in which an operation mode switching valve is easily installed inside of a casing by simplifying a structure of the operation mode switching valve. Further, embodiments disclosed herein provide a scroll compressor in which a structure of an operation mode switching valve is simplified by allowing a valve portion to be smoothly operated without installing a valve coil portion in an inner space of the casing. Furthermore, embodiments disclosed herein provide a scroll compressor in which a valve portion is smoothly operated without a coil driving portion by operating the valve portion of an operation mode switching valve using a pressure difference.

Embodiments disclosed herein provide a scroll compressor in which a connection structure of a power line for an operation of the compressor is simplified. Further, embodiments disclosed herein provide a scroll compressor in which a power line connection structure is simplified by excluding a terminal for applying power to an operation mode switching valve. Furthermore, embodiments disclosed herein provide a scroll compressor in which a power line for operating an operation mode switching valve is connected to an operation mode switching valve from outside the casing.

Embodiments disclosed herein provide a scroll compressor in which an operation reliability of an operation mode switching valve is secured and maintenance is facilitated. Further, embodiments disclosed herein provide a scroll compressor in which a linkage between a drive source of an operation mode switching valve and a valve portion is enhanced while installing the drive source outside a casing. Furthermore, embodiments disclosed herein provide a scroll compressor in which operation reliability of an operation mode switching valve is enhanced by reducing a length of a valve portion forming the operation mode switching valve.

Embodiments disclosed herein provide a scroll compressor that may include a back pressure switching unit configured to selectively communicate compression chambers, each having a different intermediate pressure, with a back pressure chamber according to an operation mode of the compressor, and a mode switching unit configured to provide a first pressure or a second pressure lower than the first pressure to the back pressure switching unit according to the operation mode of the compressor. The back pressure switching unit and the mode switching unit may be separated from each other. This may simplify a structure of an operation mode switching valve, thereby maintaining compactness of the compressor while installing the operation mode switching valve inside a casing.

Further, in embodiments disclosed herein, the back pressure switching unit may be installed inside of the casing, the mode switching unit is installed outside of the casing, and the back pressure switching unit and the mode switching unit may be connected to each other by a connection portion. Accordingly, a valve portion may be smoothly operated without installing a valve coil portion in an inner space of the casing, thereby simplifying a structure of the operation mode switching valve.

Furthermore, in embodiments disclosed herein, the mode switching unit may be configured as a solenoid valve to generate a pressure difference in the back pressure switching unit. Accordingly, the valve portion may be smoothly operated while excluding a coil driving portion from the back pressure switching unit.

In embodiments disclosed herein, a power line connected to the drive motor and a power line connected to the mode switching valve portion may be separated from each other, and the power line connected to the mode switching valve portion may be connected to the mode switching valve portion from outside the casing. This may simplify the connection structure of the power line for the operation of the compressor.

Further, according to embodiments disclosed herein, the valve coil portion constituting the operation mode switching valve may be installed outside of the casing, and the power line connected to the valve coil portion may be connected to the valve coil portion from outside of the casing. Accordingly, the power line connection structure may be simplified by excluding the terminal passing through the casing.

In embodiments disclosed herein, the mode switching unit having the valve coil portion may be installed outside of the casing, and the back pressure switching unit operated by the mode switching unit may be installed inside of the casing. The back pressure switching unit may provide selective communication between a first intermediate pressure chamber and a back pressure chamber or between a second intermediate pressure chamber, having a pressure lower than that of the first intermediate pressure chamber, and the back pressure chamber according to an operation mode of the compressor. As the valve coil portion is installed outside of the casing, this may secure operation reliability of the mode switching unit and facilitate maintenance.

Further, in embodiments disclosed herein, the mode switching unit and the back pressure switching unit may be connected to each other by a plurality of connection pipes, and the plurality of connection pipes may be coupled thereto by passing through the casing. Accordingly, an operational linkage of the back pressure switching unit may be increased while installing the mode switching unit constituting a drive source outside of the casing.

Furthermore, in embodiments disclosed herein, the back pressure switching valve of the back pressure switching unit constituting the valve portion may be configured to be moved by a pressure difference applied to opposite ends of the back pressure switching valve so as to open and close a first back pressure passage or a second back pressure passage. Accordingly, the back pressure switching valve is provided with a first communication groove and a second communication groove, resulting in reducing a length of the back pressure switching valve and the number of sealing members configured to seal the first communication groove and the second communication groove. This may reduce a weight and frictional resistance of the back pressure switching valve, thereby improving operational reliability of the back pressure switching unit.

In addition, in embodiments disclosed herein, an inner space of a casing may be divided into a low-pressure portion and a high-pressure portion. A compression chamber formed by an orbiting scroll and a non-orbiting scroll provided in the inner space of the casing may include a plurality of intermediate pressure chambers each having a different pressure and forming an intermediate pressure between a suction pressure and a discharge pressure. A back pressure chamber may be formed in the back pressure plate coupled to the non-orbiting scroll, and the back pressure chamber may communicate with the compression chamber through a first intermediate pressure hole and a second intermediate pressure hole. The second intermediate pressure hole may communicate with a compression chamber having a pressure lower than that of the first intermediate pressure hole. A third intermediate pressure hole configured to connect the compression chamber and the low-pressure portion may be provided. A back pressure switching unit configured to selectively connect the first intermediate pressure hole and the back pressure chamber or the second intermediate pressure hole and the back pressure chamber may be provided. A capacity variable unit configured to selectively open and close between the third intermediate pressure hole and the low-pressure portion may be provided. A mode switching unit configured to selectively provide a suction pressure or a discharge pressure to the back pressure switching unit and the capacity variable unit may be provided outside of the casing so as to control opening and closing operations of the back pressure switching unit and the capacity variable unit. This may simplify the structure of the back pressure switching unit and the mode switching unit so as to maintain compactness of the compressor while installing the back pressure switching unit inside of the casing, thereby securing operation reliability of the mode switching unit and facilitating maintenance.

The first intermediate pressure hole and the second intermediate pressure hole may be connected to the back pressure chamber through a common intermediate pressure hole. The common intermediate pressure hole may be formed such that the first intermediate pressure hole and the second intermediate pressure hole are joined with the back pressure switching unit interposed therebetween.

A pair of the compression chamber may be formed, and a plurality of the third intermediate pressure hole may be provided to communicate with each of the compression chambers. The plurality of third intermediate pressure holes may be separated from each other to be respectively connected to the low-pressure portion by each of the capacity variable units.

A pair of the compression chamber may be formed, and a plurality of the third intermediate pressure hole may be provided to communicate with each of the compression chambers. The plurality of third intermediate pressure holes may be combined with each other to be collectively connected to the low-pressure portion by a single capacity variable unit.

The back pressure switching unit may include a back pressure switching valve accommodating portion formed to cross a middle portion of the first intermediate pressure hole and a middle portion the second intermediate pressure hole, and a back pressure switching valve inserted in the back pressure switching valve accommodating portion to be movable between opposite ends of the back pressure switching valve accommodating portion so as to selectively open and close the first intermediate pressure hole and the second intermediate pressure hole by the mode switching unit. The back pressure switching unit may move to a first position in which the first intermediate pressure hole is closed and the second intermediate pressure hole is opened in a power operation, and moves to a second position in which the first intermediate pressure hole is opened and the second intermediate pressure hole is closed in a saving operation.

At a lower portion of the back pressure switching valve accommodating portion, the first intermediate pressure hole and the second intermediate pressure hole may be formed to be spaced apart from each other by a predetermined gap in a lengthwise direction of the back pressure switching valve accommodating portion. At an upper portion of the back pressure switching valve accommodating portion, a common intermediate pressure hole may be formed to selectively communicate with the first intermediate pressure hole or with the second intermediate pressure hole by the back pressure switching valve.

One or a first end of the back pressure switching valve accommodating portion may be provided with a communication hole that communicates with the back pressure chamber. Another or a second end of the back pressure switching valve accommodating portion may be provided with a common side connection pipe that extends from the mode switching unit to be coupled to the another or a second end of the back pressure switching valve accommodating portion, so that refrigerant at a first pressure, which is higher than a pressure in the back pressure chamber, is provided to the back pressure switching valve or refrigerant at a second pressure, which is lower than the pressure in the back pressure chamber is provided to the back pressure switching valve.

The mode switching unit and the capacity variable unit may be connected to each other by a mode switching passage. One or a first end of the mode switching passage may be connected to the back pressure switching valve accommodating portion between the common side connection pipe and an end portion of the back pressure switching valve facing the common side connection pipe.

An outer circumferential surface of the back pressure switching valve may be formed with a first communication groove and a second communication groove. A sealing member may be provided at respectively one or a first end of the back pressure switching valve, another or a second end of the back pressure switching valve, and between the first communication groove and the second communication groove inserted thereinto to seal the first communication groove and the second communication groove with respect to the back pressure vale accommodating portion.

A plurality of each of the third intermediate pressure hole and the capacity variable unit may be provided, and each of the plurality of the third intermediate pressure holes may be independently opened and closed by each of the plurality of capacity variable units. Each of the plurality of capacity variable units may be connected to the mode switching unit by the back pressure switching unit.

A plurality of the third intermediate pressure hole may be provided in plurality, and the plurality of third intermediate pressure holes may be connected to each other by a capacity variable communication passage. An end portion of any one of the plurality of third intermediate pressure holes may be connected to the capacity variable unit, and the capacity variable unit may be connected to the mode switching unit by the back pressure switching unit.

The back pressure switching unit may include a back pressure switching valve accommodating portion formed to cross a middle portion of the first intermediate pressure hole and a middle portion of the second intermediate pressure hole. The back pressure switching valve accommodating portion may be formed in a direction crossing a radial direction passing through a center of the back pressure chamber.

The back pressure switching unit may include a back pressure switching valve accommodating portion formed to cross a middle portion of the first intermediate pressure hole and a middle portion of the second intermediate pressure hole. The back pressure switching valve accommodating portion may be formed in a radial direction passing through a center of the back pressure chamber.

The capacity variable unit may include a valve housing coupled to the back pressure plate or the non-orbiting scroll, and a capacity variable valve slidably inserted into the valve housing to selectively open and close the third intermediate pressure hole. The valve housing may be formed with a differential pressure space configured to provide a suction pressure or a discharge pressure to the capacity variable valve, and the differential pressure space may be connected to the mode switching unit by an injection hole provided in the valve housing.

The back pressure plate or the non-orbiting scroll may be formed with a back pressure switching valve accommodating portion configured to communicate with the first intermediate pressure hole and the second intermediate pressure hole. A common side connection pipe that extends from the mode switching unit may be connected to the back pressure switching valve accommodating portion. The injection hole may be connected to the mode switching unit by a mode switching passage configured to communicate with the back pressure switching valve accommodating portion.

Embodiments disclosed herein further provide a scroll compressor that may include a casing, a drive motor, an orbiting scroll, a non-orbiting scroll, a back pressure assembly, a back pressure switching unit, and a mode switching unit. The drive motor may be provided in an inner space of the casing. The orbiting scroll may be operated by the drive motor. The non-orbiting scroll may be coupled to the orbiting scroll to form a compression chamber. The back pressure chamber assembly may be provided on an upper surface of the non-orbiting scroll to form a back pressure chamber so as to press the non-orbiting scroll toward the orbiting scroll. The back pressure switching unit may be installed inside of the casing and configured to selectively communicate compression chambers, each having a different intermediate pressure, with the back pressure chamber according to an operation mode of the compressor. The mode switching unit may be installed outside of the casing and connected to the back pressure switching unit to provide a first pressure or a second pressure lower than the first pressure to the back pressure switching unit according to the operation mode of the compressor. The back pressure switching unit and the mode switching unit may be connected to each other by a connection portion passing through the casing.

The mode switching unit may include a valve power supply, a mode switching valve portion, and a mode switching connection portion. The valve power supply may be provided with a valve actuator inside of a valve coil that receives power. The mode switching valve portion may be provided at one side of the valve power supply and operated by the valve power supply to change a flow direction of refrigerant. One or a first end of the mode switching connection portion may be connected to the mode switching valve portion, and another or a second end of the mode switching connection portion may be formed through the casing so as to be connected to a discharge side, to an inner space of the casing, and to the back pressure switching unit, respectively.

A power line connected to the drive motor and a power line connected to the mode switching valve portion may be separated from each other. The power line connected to the mode switching valve portion may be from outside the casing.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a low-pressure portion and a high-pressure portion provided in an inner space of the casing;

at least one compression chamber formed by an orbiting scroll and a non-orbiting scroll provided in the inner space of the casing, and including a plurality of intermediate pressure chambers each having a different pressure and forming an intermediate pressure between a suction pressure and a discharge pressure;

a back pressure chamber formed in a back pressure plate coupled to the non-orbiting scroll;

a first intermediate pressure hole configured to connect the at least one compression chamber and the back pressure chamber;

a second intermediate pressure hole having a pressure lower than a pressure of the first intermediate pressure hole and configured to connect the at least one compression chamber and the back pressure chamber;

at least one third intermediate pressure hole configured to connect the at least one compression chamber and the low-pressure portion;

a back pressure switching unit configured to selectively connect the first intermediate pressure hole and the back pressure chamber or the second intermediate pressure hole and the back pressure chamber;

at least one capacity variable unit configured to selectively open and close the at least one third intermediate pressure hole; and a mode switching unit provided outside of the casing and configured to selectively provide the suction pressure or the discharge pressure to the back pressure switching unit and the at least one capacity variable unit to control opening and closing operations of the back pressure switching unit and the at least one capacity variable unit.

2. The scroll compressor of claim 1, wherein the first intermediate pressure hole and the second intermediate pressure hole are connected to the back pressure chamber through a common intermediate pressure hole, and wherein the common intermediate pressure hole is formed such that the first intermediate pressure hole and the second intermediate pressure hole are joined with the back pressure switching unit interposed therebetween.

3. The scroll compressor of claim 1, wherein the at least one compression chamber comprises a pair of compression chambers, wherein the at least one third intermediate hole comprises a plurality of third intermediate pressure holes that communicate with the plurality of compression chambers, respectively, wherein the at least one capacity variable unit comprises a plurality of capacity variable units, and wherein the plurality of third intermediate pressure holes is separated from each other and connected to the low-pressure portion by the plurality of capacity variable units, respectively.

4. The scroll compressor of claim 1, wherein the at least one compression chamber comprises a pair of compression chambers, wherein the at least one third intermediate hole comprises a plurality of third intermediate pressure holes that communicate with the pair of compression chambers, respectively, and wherein the plurality of third intermediate pressure holes is combined to be collectively connected to the low-pressure portion by the at least one capacity variable unit.

5. The scroll compressor of claim 1, wherein the back pressure switching unit comprises:

a back pressure switching valve accommodating portion formed to cross the first intermediate pressure hole and the second intermediate pressure hole; and a back pressure switching valve inserted in the back pressure switching valve accommodating portion to be movable by the mode switching unit between opposite ends of the back pressure switching valve accommodating portion so as to selectively open and close the first intermediate pressure hole and the second intermediate pressure hole, and wherein the back pressure switching valve moves to a first position in which the first intermediate pressure hole is closed and the second intermediate pressure hole is opened in a power operation, and moves to a second position in which the first intermediate pressure hole is opened and the second intermediate pressure hole is closed in a saving operation.

6. The scroll compressor of claim 5, wherein the first intermediate pressure hole and the second intermediate pressure hole are formed at a lower portion of the back pressure switching valve accommodating portion to be spaced apart from each other by a predetermined gap in a lengthwise direction of the back pressure switching valve accommodating portion, and wherein a common intermediate pressure hole is formed at an upper portion of the back pressure switching valve accommodating portion to selectively communicate with the first intermediate pressure hole or the second intermediate pressure hole via the back pressure switching valve.

7. The scroll compressor of claim 5, wherein a first end of the back pressure switching valve accommodating portion is provided with a communication hole that communicates with the back pressure chamber, and a second end of the back pressure switching valve accommodating portion is provided with a common side connection pipe that extends from the mode switching unit to be coupled to the second end of the back pressure switching valve accommodating portion, so that refrigerant at a first pressure, which is higher than a pressure in the back pressure chamber, is provided to the back pressure switching valve or refrigerant at a second pressure, which is lower than the pressure in the back pressure chamber, is provided to the back pressure switching valve.

8. The scroll compressor of claim 7, wherein the mode switching unit and the at least one capacity variable unit are connected to each other by a mode switching passage, and wherein a first end of the mode switching passage is connected to the back pressure switching valve accommodating portion between the common side connection pipe and an end portion of the back pressure switching valve facing the common side connection pipe.

9. The scroll compressor of claim 5, wherein a first communication groove and a second communication groove are formed on an outer circumferential surface of the back pressure switching valve, and wherein sealing members are disposed on a first end of the back pressure switching valve, on a second end of the back pressure switching valve, and between the first communication groove and the second communication groove, respectively, to seal the first communication groove and the second communication groove with respect to the back pressure valve accommodating portion.

10. The scroll compressor of claim 1, wherein the at least one third intermediate pressure hole comprises a plurality of third intermediate pressure holes and the at least one capacity variable unit comprises a plurality of capacity variable units, wherein the plurality of third intermediate pressure holes is independently opened and closed by the plurality of capacity variable units, respectively, and wherein each of the plurality of capacity variable units is connected to the mode switching unit by the back pressure switching unit.

11. The scroll compressor of claim 1, wherein the at least one third intermediate pressure hole comprises a plurality of third intermediate pressure holes, wherein the plurality of third intermediate pressure holes is connected to each other by a capacity variable communication passage, wherein an end portion of any one of the plurality of third intermediate pressure holes is connected to the at least one capacity variable unit, and wherein the at least one capacity variable unit is connected to the mode switching unit by the back pressure switching unit.

12. The scroll compressor of claim 1, wherein the back pressure switching unit comprises a back pressure switching valve accommodating portion formed to cross the first intermediate pressure hole and the second intermediate pressure hole, and wherein the back pressure switching valve accommodating portion is formed in a direction crossing a radial direction passing through a center of the back pressure chamber.

13. The scroll compressor of claim 1, wherein the back pressure switching unit comprises a back pressure switching valve accommodating portion formed to cross the first intermediate pressure hole and the second intermediate pressure hole, and wherein the back pressure switching valve accommodating portion is formed in a radial direction passing through a center of the back pressure chamber.

14. The scroll compressor of claim 1, wherein the at least one capacity variable unit comprises: a valve housing coupled to the back pressure plate or the non-orbiting scroll; and a capacity variable valve slidably inserted into the valve housing to selectively open and close the at least one third intermediate pressure hole, wherein the valve housing is formed with a differential pressure space configured to provide the suction pressure or the discharge pressure to the at least one capacity variable valve, and wherein the differential pressure space is connected to the mode switching unit by an injection hole provided in the valve housing.

15. The scroll compressor of claim 14, wherein the back pressure plate or the non-orbiting scroll is provided with a back pressure switching valve accommodating portion configured to communicate with the first intermediate pressure hole and the second intermediate pressure hole, wherein a common side connection pipe that extends from the mode switching unit is connected to the back pressure switching valve accommodating portion, and wherein the injection hole is connected to the mode switching unit by a mode switching passage configured to communicate with the back pressure switching valve accommodating portion.

16. A scroll compressor, comprising:

a casing;

a drive motor provided at an inner space of the casing;

an orbiting scroll operated by the drive motor;

a non-orbiting scroll coupled to the orbiting scroll to form a plurality of compression chambers including a suction pressure chamber, a discharge pressure chamber, and a plurality of intermediate pressure chambers;

a back pressure chamber assembly provided on an upper surface of the non-orbiting scroll to form a back pressure chamber so as to press the non-orbiting scroll toward the orbiting scroll;

a back pressure switching unit installed inside of the casing and configured to selectively provide communication between the plurality of intermediate pressure chambers, each having a different intermediate pressure, with the back pressure chamber according to an operation mode of the compressor; and a mode switching unit installed outside of the casing and connected to the back pressure switching unit to provide a first pressure or a second pressure lower than the first pressure to the back pressure switching unit according to the operation mode of the compressor, wherein the back pressure switching unit and the mode switching unit are connected to each other by a connection portion that passes through the casing.

17. The scroll compressor of claim 16, wherein the mode switching unit comprises:

a valve power supply provided with a valve actuator inside of a valve coil that receives power;

a mode switching valve portion provided at one side of the valve power supply and operated by the valve power supply to change a flow direction of refrigerant; and a mode switching connection portion formed such that a first end of the mode switching connection portion is connected to the mode switching valve portion, and a second end of the mode switching connection portion is formed through the casing so as to be connected at a discharge side, to the inner space of the casing, and to the back pressure switching unit, respectively.

18. The scroll compressor of claim 17, wherein a power line connected to the drive motor and a power line connected to the mode switching valve portion are separated from each other, and wherein the power line connected to the mode switching valve portion is connected from outside the casing.

19. A scroll compressor, comprising:

a casing;

a low-pressure portion and a high-pressure portion provided in an inner space of the casing;

at least one compression chamber formed by an orbiting scroll and a non-orbiting scroll provided in the inner space of the casing, and including a plurality of intermediate pressure chambers each having a different pressure between a first pressure and a second pressure;

a back pressure chamber formed in a back pressure plate coupled to the non-orbiting scroll;

a first intermediate pressure hole configured to connect the at least one compression chamber and the back pressure chamber;

a second intermediate pressure hole having a pressure lower than a pressure of the first intermediate pressure hole and configured to connect the at least one compression chamber and the back pressure chamber;

at least one third intermediate pressure hole configured to connect the at least one compression chamber and the low-pressure portion;

a back pressure switching unit configured to selectively connect the first intermediate pressure hole and the back pressure chamber or the second intermediate pressure hole and the back pressure chamber;

at least one capacity variable unit configured to selectively open and close the at least one third intermediate pressure hole; and a mode switching unit provided outside of the casing and configured to selectively provide the first pressure or the second pressure to the back pressure switching unit and the at least one capacity variable unit to control opening and closing operations of the back pressure switching unit and the at least one capacity variable unit, wherein the back pressure switching unit comprises:

a back pressure switching valve accommodating portion formed to cross the first intermediate pressure hole and the second intermediate pressure hole; and a back pressure switching valve inserted in the back pressure switching valve accommodating portion to be movable by the mode switching unit between opposite ends of the back pressure switching valve accommodating portion so as to selectively open and close the first intermediate pressure hole and the second intermediate pressure hole, and wherein the back pressure switching valve moves to a first position in which the first intermediate pressure hole is closed and the second intermediate pressure hole is opened in a power operation, and moves to a second position in which the first intermediate pressure hole is opened and the second intermediate pressure hole is closed in a saving operation.

20. The scroll compressor of claim 19, wherein the first intermediate pressure hole and the second intermediate pressure hole are formed at a lower portion of the back pressure switching valve accommodating portion to be spaced apart from each other by a predetermined gap in a lengthwise direction of the back pressure switching valve accommodating portion, and wherein a common intermediate pressure hole is formed at an upper portion of the back pressure switching valve accommodating portion to selectively communicate with the first intermediate pressure hole or the second intermediate pressure hole via the back pressure switching valve.

21. The scroll compressor of claim 19, wherein a first end of the back pressure switching valve accommodating portion is provided with a communication hole that communicates with the back pressure chamber, and a second end of the back pressure switching valve accommodating portion is provided with a common side connection pipe that extends from the mode switching unit to be coupled to the second end of the back pressure switching valve accommodating portion, so that refrigerant at a first pressure, which is higher than a pressure in the back pressure chamber, is provided to the back pressure switching valve or refrigerant at a second pressure, which is lower than the pressure in the back pressure chamber, is provided to the back pressure switching valve.

22. The scroll compressor of claim 21, wherein the mode switching unit and the at least one capacity variable unit are connected to each other by a mode switching passage, and wherein a first end of the mode switching passage is connected to the back pressure switching valve accommodating portion between a common side connection pipe and an end portion of the back pressure switching valve facing the common side connection pipe.

23. The scroll compressor of claim 19, wherein a first communication groove and a second communication groove are formed on an outer circumferential surface of the back pressure switching valve, and wherein sealing members are disposed on a first end of the back pressure switching valve, on a second end of the back pressure switching valve, and between the first communication groove and the second communication groove, respectively, to seal the first communication groove and the second communication groove with respect to the back pressure valve accommodating portion.

* * * * *